US009134648B2

(12) United States Patent
Koido

(10) Patent No.: US 9,134,648 B2
(45) Date of Patent: Sep. 15, 2015

(54) IMAGE FORMING UNIT AND IMAGE FORMING APPARATUS

(71) Applicant: Oki Data Corporation, Tokyo (JP)

(72) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 103 days.

(21) Appl. No.: 13/783,210

(22) Filed: Mar. 1, 2013

(65) Prior Publication Data

US 2013/0230342 A1 Sep. 5, 2013

(30) Foreign Application Priority Data

Mar. 2, 2012 (JP) ..... 2012-046494

(51) Int. Cl.
*G03G 15/08* (2006.01)
*G03G 15/00* (2006.01)

(52) U.S. Cl.
CPC ..... *G03G 15/0806* (2013.01); *G03G 15/0808* (2013.01); *G03G 15/0815* (2013.01); *G03G 15/80* (2013.01)

(58) Field of Classification Search
CPC ..... G03G 15/0815
USPC ..... 399/281, 283, 285, 271, 272, 273, 279
See application file for complete search history.

(56) References Cited

U.S. PATENT DOCUMENTS 5,592,265 A * 1/1997 Sakuraba et al. ..... 399/285
5,594,198 A * 1/1997 Ikeda et al. ..... 399/281
5,781,827 A * 7/1998 Shimada et al. ..... 399/55

FOREIGN PATENT DOCUMENTS

| | | |
|---|---|---|
| JP | 62-211674 | 9/1987 |
| JP | 7-72732 | 3/1995 |
| JP | 08-6387 | 1/1996 |
| JP | 8-36299 | 2/1996 |
| JP | 8-62960 | 3/1996 |
| JP | 11-015246 A | 1/1999 |

* cited by examiner

*Primary Examiner* — David Gray
*Assistant Examiner* — Sevan A Aydin
(74) *Attorney, Agent, or Firm* — Rabin & Berdo, P.C.

(57) ABSTRACT

An image forming unit includes a developer bearing body that bears a developer, and a supplying member provided so as to face the developer bearing body. The supplying member rotates to thereby collect the developer from the developer bearing body and supply the developer to the developer bearing body. The image forming unit further includes a developer storage portion that stores the developer to be supplied to the supplying member, and a charge providing member that charges the developer held on the supplying member. In a rotating direction of the supplying member, the charge providing member is disposed on a downstream side of an opposing portion between the developer bearing body and the supplying member and on an upstream side of a region where the developer storage portion supplies the developer to the supplying member.

22 Claims, 18 Drawing Sheets

COMPARISON EXAMPLE

COMPARISON EXAMPLE

COMPARISON EXAMPLE

COMPARISON EXAMPLE

IMAGE FORMING UNIT AND IMAGE FORMING APPARATUS

BACKGROUND OF THE INVENTION

The present invention relates to an image forming apparatus such as a printer, a copier and a facsimile machine, and also relates to an image forming unit used in the image forming apparatus.

In an image forming apparatus using electrophotography, a latent image is formed on a photosensitive drum, and the latent image is developed by a developing device.

A general developing device includes a developer bearing body that bears a developer (i.e., a toner), a supplying member that supplies the developer to the developer bearing body, and an auxiliary member that supplies the developer to the supplying member. Such a developing device is disclosed in, for example, Japanese Laid-open Patent Publication No. H11-15246 (FIG. 1).

However, the general developing device still cannot provide sufficient image quality.

SUMMARY OF THE INVENTION

An aspect of the present invention is intended to provide an image forming apparatus and an image forming unit capable of enhancing image quality.

According to an aspect of the present invention, there is provided an image forming unit including a developer bearing body that bears a developer, and a supplying member provided so as to face the developer bearing body. The supplying member rotates to thereby collect the developer from the developer bearing body and supply the developer to the developer bearing body. The image forming unit further includes a developer storage portion that stores the developer to be supplied to the supplying member, and a charge providing member that charges the developer held on the supplying member. In a rotating direction of the supplying member, the charge providing member is disposed on a downstream side of an opposing portion between the developer bearing body and the supplying member and on an upstream side of a region where the developer storage portion supplies the developer to the supplying member.

With such a configuration, image quality can be enhanced.

According to another aspect of the present invention, there is provided an image forming apparatus including the above described image forming unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment.

<Configuration of Image Forming Apparatus>

Figure 1:
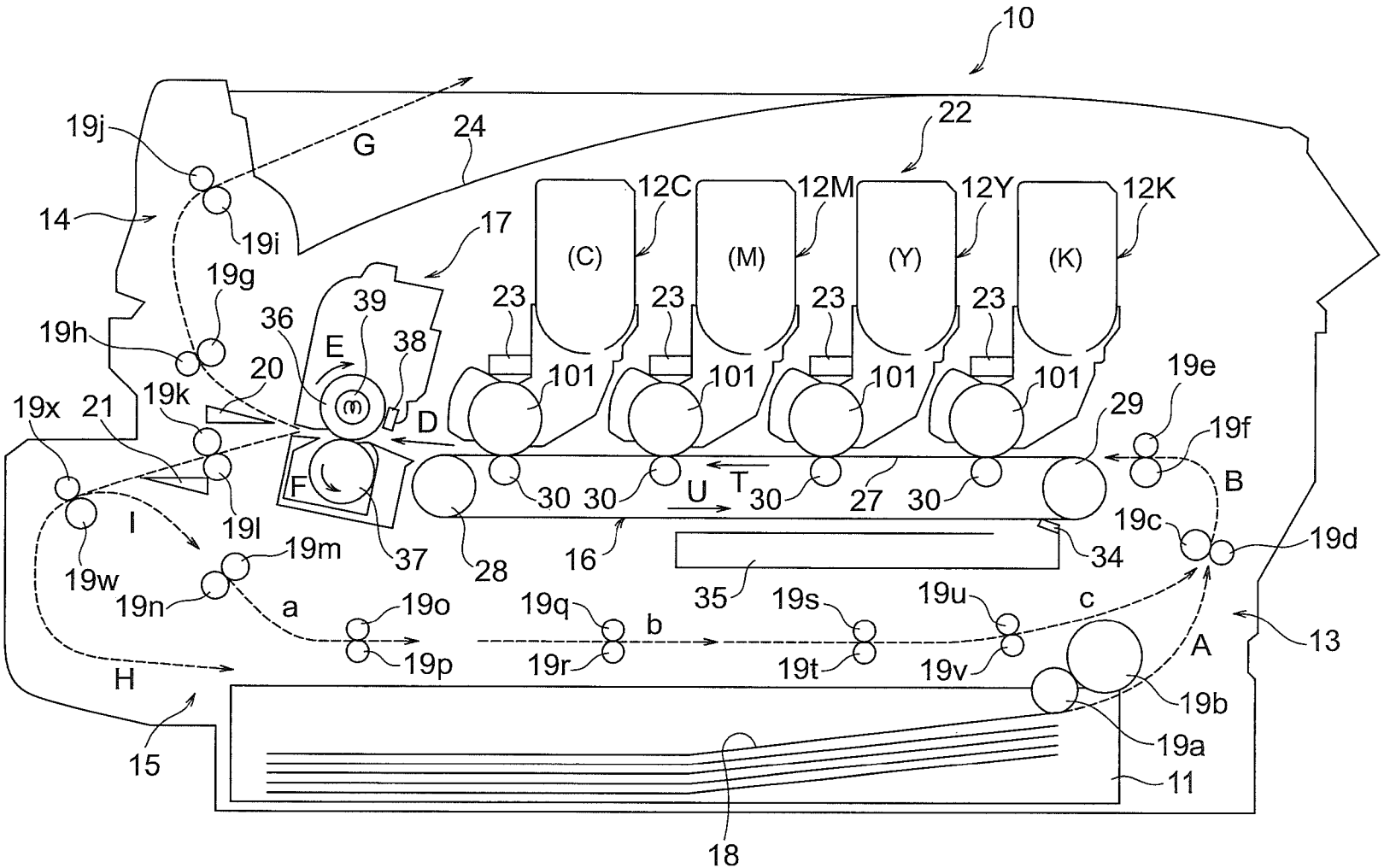
FIG. 1 is a schematic view showing a configuration of an image forming apparatus according to the first embodiment of the present invention.

FIG. 1 is a schematic view showing an image forming apparatus 10 according to the first embodiment of the present invention. The image forming apparatus 10 is configured as an electrophotographic color printer.

The image forming apparatus 10 includes a medium cassette 11 storing a plurality of printing sheets (i.e., media) 18, and an image forming section 22 that forms toner images (i.e., developer images) of black, yellow, magenta and cyan on the printing sheet 18, and a fixing unit 17 that fixes the toner image to the printing sheet 18.

The image forming apparatus 10 further includes a medium feeding unit 13 that feeds the printing sheet 18 from the medium cassette 11 to the image forming section 22, and a medium ejection unit 14 that ejects the printing sheet 18 (fed out from the fixing unit 17) to outside the image forming apparatus 10.

The image forming apparatus 10 further includes a medium inverting unit 15 that inverts the printing sheet 18 for image formation on a back surface in a double-side printing mode, and switching guides 20 and 21.

The medium cassette 11 stores a stack of the printing sheets (media) 18. The medium cassette 11 is detachably mounted to a lower part of the image forming apparatus 10.

The medium feeding portion 13 includes a pickup roller 19*a* and a feeding roller 19*b*. The pickup roller 19*a* and the feeding roller 19*b* are configured to pick up the printing sheets 18 one by one, and feed each printing sheet 18 into a feeding path as shown by an arrow A.

The medium feeding unit 13 further includes a pair of conveying rollers 19*c* and 19*d*, and another pair of conveying rollers 19*e* and 19*f*. The conveying rollers 19*c* and 19*d* and the conveying rollers 19*e* and 19*f* are configured to convey the printing sheet 18 (fed from the pickup roller 19*a* and feeding roller 19*b*) in a direction shown by an arrow B toward the image forming section 22 while correcting a skew of the printing sheet 18. In this regard, the arrows A and B and other dashed arrows indicate a conveying direction and a conveying path of the printing sheet 18.

The image forming section 22 includes four image forming units 12K, 12Y, 12M and 12C arranged in a row along the conveying path of the printing sheet 18. The image forming section 22 further includes four LED (Light Emitting Diode) heads 23 as exposure units, and a transfer unit 16 that transfers toner images (formed by the image forming units 12K, 12Y, 12M and 12C) to the printing sheet 18.

The image forming units 12K, 12Y, 12M and 12C are respectively configured to form toner images (i.e., developer images) of black (K), yellow (Y), magenta (M) and cyan (C). The image forming units 12K, 12Y, 12M and 12C are detachably mounted to a main body of the image forming apparatus 10. The image forming units 12K, 12Y, 12M and 12C have the same configurations except the toners (developers). Configurations of the image forming units 12K, 12Y, 12M and 12C will be described later.

The transfer unit 16 includes a transfer belt 27 that electrostatically absorbs the printing sheet 18 and conveys the printing sheet 18. The transfer unit 16 includes a drive roller 28 and a tension roller 29 around which the transfer belt 27 is stretched. The transfer unit 16 further includes four transfer rollers 30 (i.e., transfer members). The transfer rollers 30 are provided so as to face respective photosensitive drums 101 (described later) of the image forming units 12K, 12Y, 12M and 12C.

The drive roller 28 is driven by a conveying motor 508 (FIG. 5) to rotate. The drive roller 28 rotates to cause the transfer belt 27 to rotate in a direction shown by arrows T and U. The tension roller 29 applies a predetermined tension to the transfer belt 27.

The transfer belt 27 absorbs the printing sheet 18 on a surface of the transfer belt 27. The transfer belt 27 rotates by a rotation of the drive roller 28, and conveys the printing sheet 18 along the image forming units 12K, 12Y, 12M and 12C. The transfer belt 27 is formed of polyamide-imide, polyamide or the like to which carbon or the like is added for imparting predetermined electrical conductivity and mechanical strength.

The transfer rollers 30 are pressed against the respective photosensitive drums 101 via the transfer belt 27. The transfer rollers 30 are applied with transfer voltages for transferring the toner images from the photosensitive drums 101 to the medium 18.

The transfer portion 16 includes a transfer belt cleaning blade 34 that scrapes off a residual toner from the transfer belt 27, and a waste developer tank 35 for storing the toner scraped off from the transfer belt 27. The transfer belt cleaning blade 34 is formed of a resilient body such as urethane rubber, epoxy rubber, acrylic rubber, fluoro-resin rubber, NBR (nitrile butadiene rubber), SBR (styrene butadiene rubber), IR (isoprene rubber) or polybutadiene rubber. In a particular example, the transfer belt cleaning blade 34 is formed of urethane rubber.

The fixing unit 17 is provided on a downstream side (i.e., left side) of the image forming section 22 in the conveying direction of the printing sheet 18. The fixing unit 17 includes a heating roller 36, a pressure roller 37, a thermistor 38 and a heater 39.

The heating roller 36 includes a metal core having a cylindrical hollow shape, and a heat-resistant resilient layer formed on a surface of the metal core. The metal core is formed of aluminum. The resilient layer is formed of silicone rubber. Further, the resilient layer is covered with a tube formed of PFA (tetra fluoro ethylene-perfluoro alkylvinyl ether copolymer) or the like. A heater 39 such as a halogen lamp is provided inside the metal core of the heating roller 36.

The pressure roller 37 includes a metal core, and a heat-resistant resilient layer formed on a surface of the metal core. The metal core is formed of aluminum. The heat-resistant resilient layer is formed of silicone rubber. The resilient layer is covered with a tube formed of PFA or the like. A nip portion is formed between the heating roller 36 and the pressure roller 37 for applying heat and pressure to the printing sheet 18.

Figure 5:
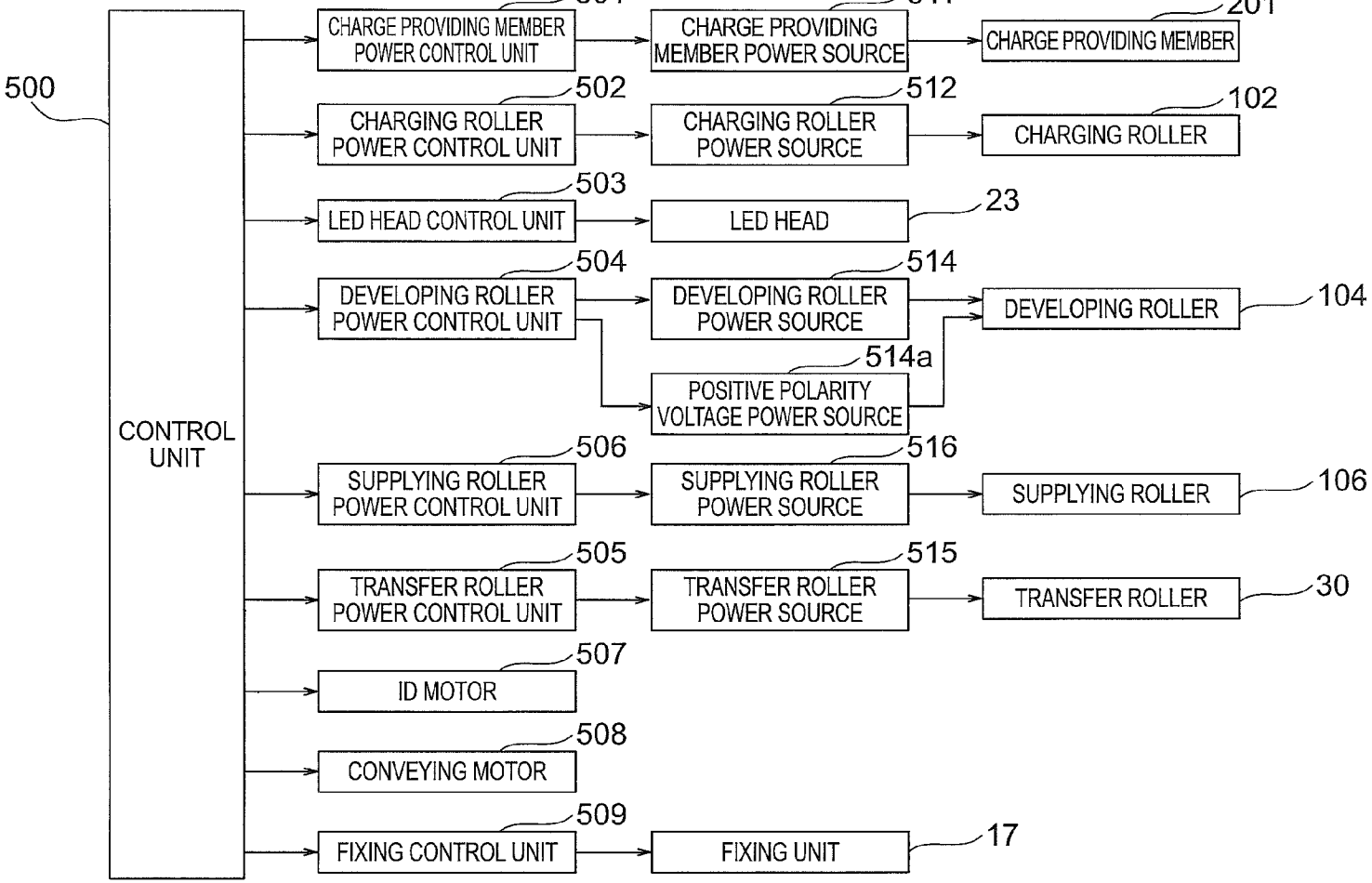
FIG. 5 is a block diagram showing a main part of a control system of the image forming apparatus according to the first embodiment.

The thermistor 38 functions as a detecting unit of a surface temperature of the heating roller 36. The thermistor 38 is provided in the vicinity of the heating roller 36 so as not to contact the heating roller 36. The thermistor 38 detects a surface temperature of the heating roller 36, and sends temperature information to a fixing control unit 509 (FIG. 5). The fixing control unit 509 performs ON/OFF control of the heater 39 based on the temperature information from the thermistor 38 so as to maintain the surface temperature of the heating roller 36 to a predetermined temperature.

A switching guide 20 is provided on a downstream side (i.e., left side) of the fixing unit 17 in the conveying direction of the printing sheet 18. The switching guide 20 is configured to switch between conveying paths of the printing sheet 18. The switching guide 20 is configured to selectively guide the printing sheet 18 (fed from the fixing unit 17) to the medium ejection unit 14 or the medium inverting unit 15 (for printing on a back surface of the printing sheet 18).

The medium ejection unit 14 includes a pair of ejection rollers 19*g* and 19*h* and another pair of ejection rollers 19*i* and 19*j*. The ejection rollers 19*g* and 19*h* and the ejection rollers 19*i* and 19*j* are configured to eject the printing sheet 18 (fed from the fixing unit 17) to outside the image forming apparatus 10. A stacker portion 24 is provided on an upper cover of the image forming apparatus 10. The printing sheet 18 ejected by the medium ejection unit 14 is placed on the stacker portion 24.

The medium inverting unit 15 includes a pair of conveying rollers 19*k* and 19*l*, a switching guide 21 and another pair of conveying rollers 19*x* and 19*w*. The conveying rollers 19*k* and 19*l*, the switching guide 21 and the conveying rollers 19*x* and 19*w* are configured to temporally convey the printing sheet 18 (having passed the switching guide 20) into a retreat path, and then convey the printing sheet 18 in a reverse direction out of the retreat path. The medium inverting unit 15 further includes a pair of conveying rollers 19*m* and 19*n*, another pair of conveying rollers 19*o* and 19*p*, still another pair of conveying rollers 19*q* and 19*r*, yet another pair of conveying rollers 19*s* and 19*t*, and further pair of conveying rollers 19*u* and 19*v*. The rollers 19*m* through 19*v* are provided along a return path from the conveying rollers 19*x* and 19*w* toward the medium feeding unit 13. The rollers 19*m* through 19*v* are configured to convey the printing sheet 18 along the return path toward the medium feeding unit 13. The above described conveying rollers 19*c* and 19*d* are disposed on an exit end of the return path. The conveying rollers 19*c* and 19*d* convey the printing sheet 18 (whose orientation is inverted) conveyed along the return path to the image forming section 22.

<Configuration of Image Forming Unit>

A configuration of the image forming unit 12 will be described. The image forming units 12K, 12Y, 12M and 12C have the same configurations except toners. The image forming units 12K, 12Y, 12M and 12C are therefore collectively referred to as the image forming units 12.

Figure 2:
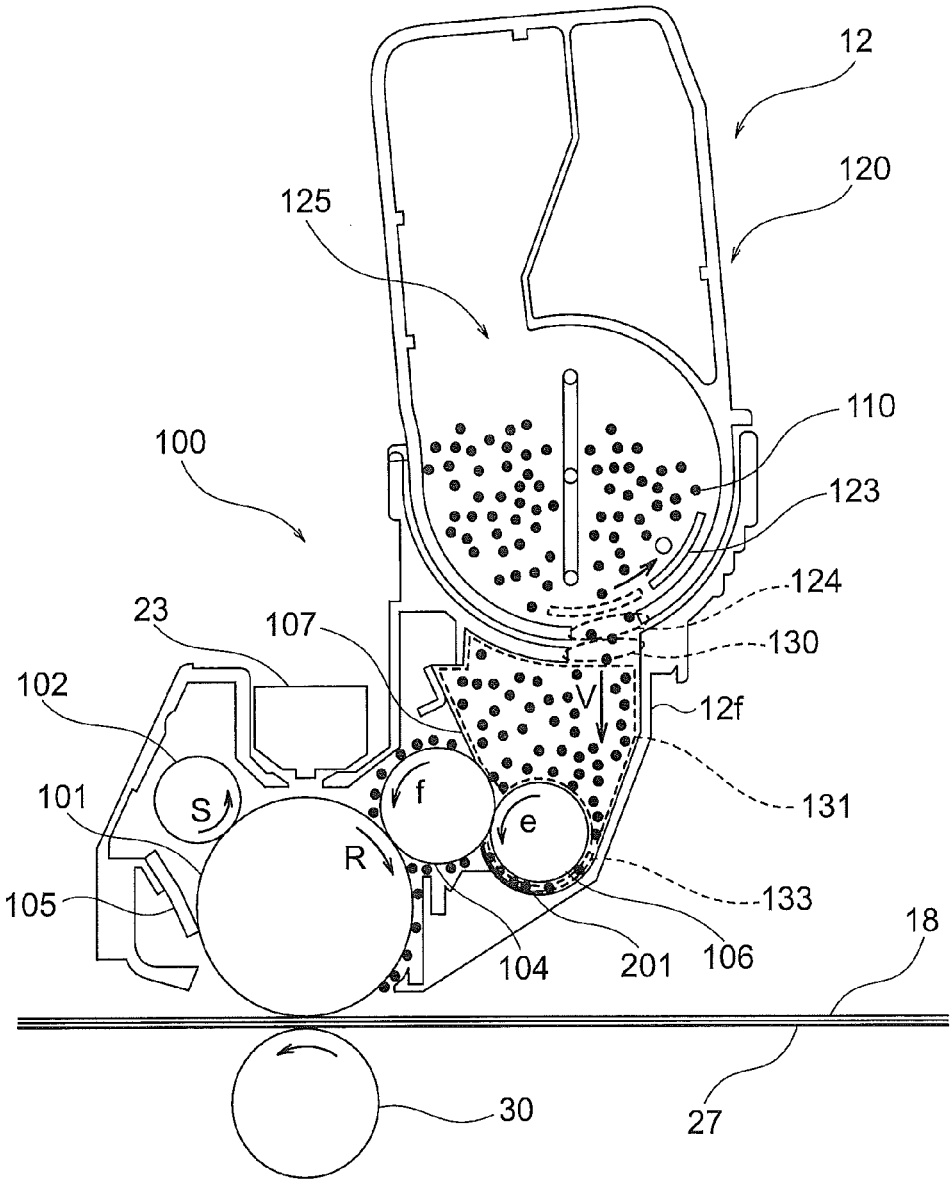
FIG. 2 is a sectional view showing an image forming unit according to the first embodiment.

FIG. 2 is a sectional view showing the configuration of the image forming unit 12. In FIG. 2, the LED head 23, the transfer roller 30 and the transfer belt 27 are also shown.

In FIG. 2, the image forming unit 12 includes a photosensitive drum 101 as a latent image bearing body. The photosensitive drum 101 rotates in a direction shown by an arrow R. A charging roller 102 as a charging member, a developing roller 104 as a developer bearing body, and a cleaning blade 105 as a cleaning member are disposed around the photosensitive drum 101. The charging roller 102, the developing roller 104, and the cleaning blade 105 are arranged in this order along a rotating direction of the photosensitive drum 101 shown by the arrow R.

A supplying roller 106 as a supplying member and a developing blade 107 as a layer regulating member are provided around the developing roller 104. A charge providing member 201 (FIG. 3) is provided so as to face the supplying roller 106. The developing roller 104, the supplying roller 106, the charge providing member 201 and the developing blade 107 constitute a developing unit 100 for developing a latent image on the surface of the photosensitive drum 101.

The image forming unit 12 further includes a toner cartridge 120 (i.e., a developer replenishing unit or a developer storage body) storing a toner 110 therein. The toner cartridge 120 is detachably mounted to the developing unit 100. Further, The image forming unit 12 is detachably mounted to a predetermined position in the image forming section 22 shown in FIG. 1.

The photosensitive drum 101 can be made of, for example, an inorganic photosensitive drum or an organic photosensitive drum. The inorganic photosensitive drum includes a conductive base roller and a photosensitive layer formed on the conductive base roller. The base roller is formed of aluminum. The photosensitive layer is formed of selenium, amorphous silicon or the like. The organic photosensitive drum includes the conductive base roller and an organic photosensitive layer formed on the conductive base roller. The organic photosensitive layer is formed of binder resin in which charge generation agent and charge transport agent are dispersed. In a particular example, the photosensitive drum 101 is made of the organic photosensitive drum including a metal pipe (i.e., the conductive base roller) formed of aluminum on which the charge generation layer and the charge transport layer are laminated. The charge generation layer and the charge transport layer form a photoconductive layer.

The charging roller 102 is provided so as to contact the surface of the photosensitive drum 101. The charging roller 102 is formed of, for example, a metal shaft and a resilient layer. The resilient layer is formed of semiconductive epichlorohydrin rubber and is provided on a surface of the metal shaft. The charging roller 102 rotates following the rotation of the photosensitive drum 101.

The LED head 23 includes LED elements and a lens array. The LED head 23 is located so that light emitted by the LED head 23 is focused on the surface of the photosensitive drum 101.

The cleaning blade 105 is provided so that a longitudinal direction of the cleaning blade 105 is parallel to a rotation axis of the photosensitive drum 101. A tip of the cleaning blade 105 is brought into contact with the surface of the photosensitive drum 101. A root part of the cleaning blade 105 is fixed to a frame 12*f* of the image forming unit 12 via a supporting plate made of a rigid body. The cleaning blade 105 contacts the surface of the photosensitive drum 101, and scrapes off the residual toner 110 from the surface of the photosensitive drum 101 when the photosensitive drum 101 rotates in the direction shown by the arrow R.

The cleaning blade 105 is formed of, for example, a resilient body such as urethane rubber, epoxy rubber, acrylic rubber, fluoro-resin rubber, NBR (nitrile butadiene rubber), SBR (styrene butadiene rubber), IR (isoprene rubber) or polybutadiene rubber. In a particular example, the cleaning blade 105 is formed of urethane rubber.

The developing roller 104 is provided so as to contact the surface of the photosensitive drum 101. The developing roller 104 rotates in a direction opposite to the rotating direction of the photosensitive drum 101. The developing roller 104 includes a shaft (i.e., a base body) having an electrical conductivity and a resilient layer formed on a surface of the shaft. The shaft is formed of, for example, stainless steel. The resilient layer is formed of silicone rubber or urethane rubber to which carbon or the like is added for adjusting electric resistance. In other words, the resilient layer is formed of material which is usually used for a resilient layer of a general developing roller. In a particular example, the resilient layer of the developing roller 104 is formed of urethane rubber.

The developing blade 107 is made of, for example, a plate member having a bent portion. The bent portion of the developing blade 107 is pressed against the surface of the developing roller 104. The developing blade 107 is formed of metal such as stainless steel or copper phosphate, or rubber such as silicone rubber. In other words, the developing blade 107 is formed of material which is usually used for a general developing blade. It is also possible to apply an appropriate voltage to the developing blade 107.

The supplying roller 106 is provided so as to face the developing roller 104. The supplying roller 106 rotates in the same direction as a rotating direction of the developing roller 104. The supplying roller 106 is made of a shaft (i.e., a base body) having electrical conductivity, and a resilient layer formed on a surface of the shaft. The shaft is formed of, for example, stainless steel. The resilient layer is formed of, for example, foamed semiconductive silicone sponge layer or foamed semiconductive urethane sponge layer. In other words, the resilient layer is formed of material which is usually used for a resilient layer of a general supplying roller. In a particular example, the resilient layer of the supplying roller 106 is formed of foamed semiconductive silicone sponge layer. In order to ensure resistance to abrasion, it is preferable that the resilient layer of the supplying roller 106 has Asker-F hardness in a range from 40 to 70 degree (JIS Z2245). Further, since current flows through the resilient layer during image formation, it is preferable that the resilient layer of the supplying roller 106 has a volume resistance in a range from $1\times10^5$ to $1\times10^8$ Ω·cm. In a particular example, the volume resistance is measured by pressing a metal circular cylinder against the resilient layer with a force of 300 gf, and by applying −300V to the resilient layer.

Figure 3:
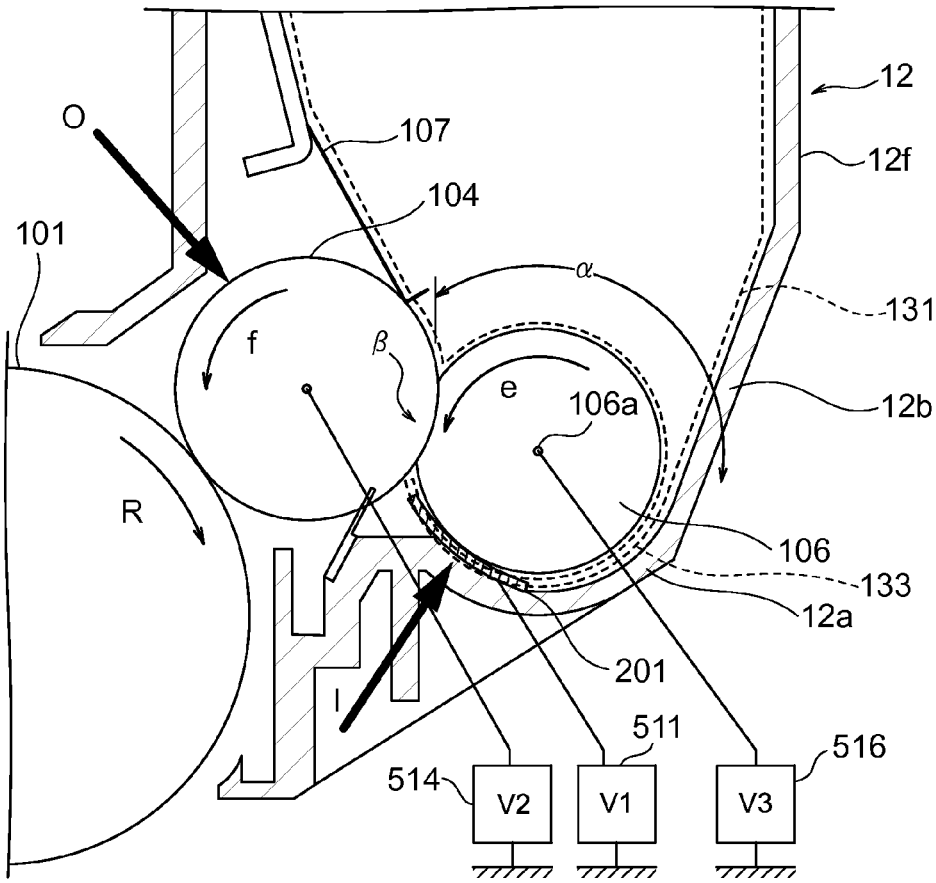
FIG. 3 is an enlarged view showing a part of the image forming unit including a supplying roller and its surroundings according to the first embodiment.

FIG. 3 is an enlarged view showing a part of the image forming unit 12 including the supporting roller 106 and its surroundings. The image forming unit 12 has a frame 12*f* that covers at least the developing roller 104, the supplying roller 106 and the developing blade 107. The frame 12*f* includes an inner wall 12*a* and an inner wall 12*b*. The inner wall 12*a* faces a predetermined region (i.e., a lower region) of the surface of the supplying roller 106. The inner wall 12*a* extends along the surface of the supplying roller 106 so that a constant gap is formed between the inner wall 12*a* and the surface of the supplying roller 106. The inner wall 12*b* extends from an end of the inner wall 12*a*. The inner wall 12*b* extends in such a manner that a gap between the inner wall 12*b* and the surface of the supplying roller 106 increases.

A region surrounded by the surface of the supplying roller 106, the developing blade 107 and the inner wall 12*b* of the image forming unit 12 constitutes a toner storage portion 131 as a developer storage portion. The toner storage portion 131 stores the toner to be supplied to the supplying roller 106. In FIG. 3, a mark "α" indicates a toner supplying region (i.e., a developer supplying region) on the supplying roller 106 where the toner is supplied from the toner storage portion 131 to the supplying roller 106.

A collected toner conveying portion (i.e., a collected developer conveying portion) 133 is defined as a region along the supplying roller 106. The collected toner conveying portion 133 extends downstream along a rotating direction (shown by an arrow e) of the supplying roller 106 from a portion (i.e., an opposing portion) where the supplying roller 106 and the developing roller 104 face each other. The collected toner conveying portion 133 has a terminal end in the vicinity of the toner supplying region α . The collected toner conveying portion 133 is a path where the toner (collected from the developing roller 104) is conveyed by the rotating supplying roller 106.

Figure 12:
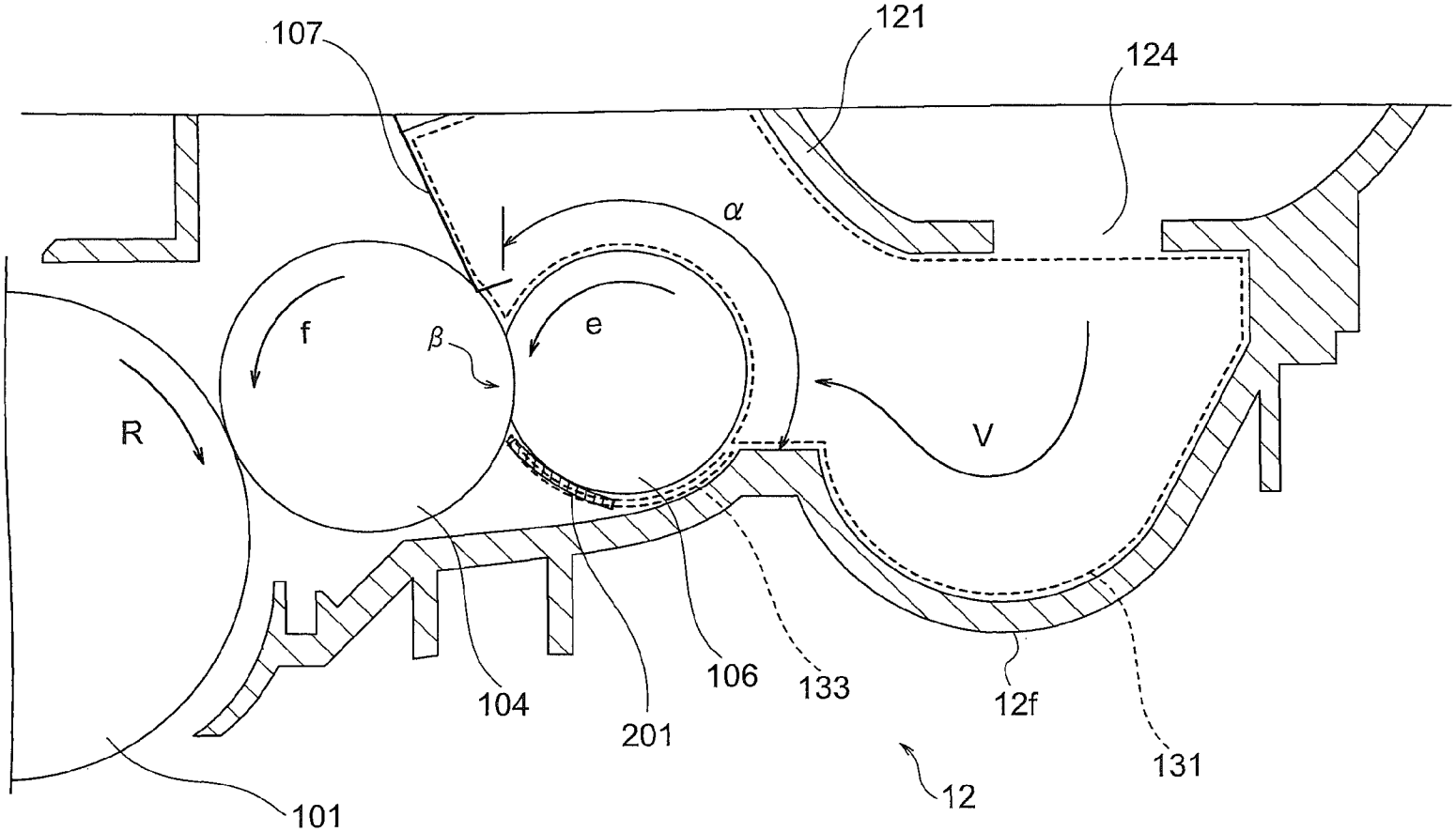
FIG. 12 is a sectional view showing a part of the image forming unit including a supplying roller and its surroundings according to the second embodiment.

The opposing portion (shown by a mark "β" in FIG. 3) where the supplying roller 106 and the developing roller 104 face each other is disposed on one side (i.e., left side in FIG. 3) with respect to a rotation center 106*a* of the supplying roller 106. The terminal end of the collected toner conveying portion 133 is disposed on the other side (i.e., right side in FIG. 3) with respect to the rotation center 106*a* of the supplying roller 106. Further, in an example shown in FIG. 3, the terminal end of the collected toner conveying portion 133 faces a part of the supplying roller 106 where a tangential line at the surface of the supplying roller 106 substantially extends vertically. However, even if the toner supplying region α reaches a lower position than that shown in FIG. 3 (for example, as shown in FIG. 12), the collected toner conveying portion 133 is defined as a region reaching the toner supplying region α.

In a particular example, the opposing portion β where the supplying roller 106 and the developing roller 104 face each other is a contact portion where the supplying roller 106 and the developing roller 104 contact each other.

With such a configuration, as the supplying roller 106 rotates in the direction shown by the arrow e, the supplying roller 106 collects the toner from the developing roller 104, and conveys the toner (collected from the developing roller 104) along the collected toner conveying portion 133. Further, the supplying roller 106 receives new toner from the toner storage portion 131, and supplies the mixed toner (i.e., the collected toner and the newly supplied toner) to the developing roller 104.

The charge providing member 201 is provided so as to face the surface of the supplying roller 106. The charge providing member 201 is configured to apply an electric charge to the toner held on the supplying roller 106 (i.e., the toner collected from the developing roller 104 by the supplying roller 106). In a particular example, the charge providing member 201 contacts the surface of the supplying roller 106.

The charge providing member 201 is in the form of a plate. The charge providing member 201 is formed of conductive or semiconductive member. For example, the charge providing member 201 is made of a plate spring formed of stainless steel or copper phosphate. Alternatively, the charge providing member 201 can be made of silicone rubber, urethane rubber or the like to which carbon or the like is added for imparting electrical conductivity. The charge providing member 201 is applied with a voltage.

Figure 4:
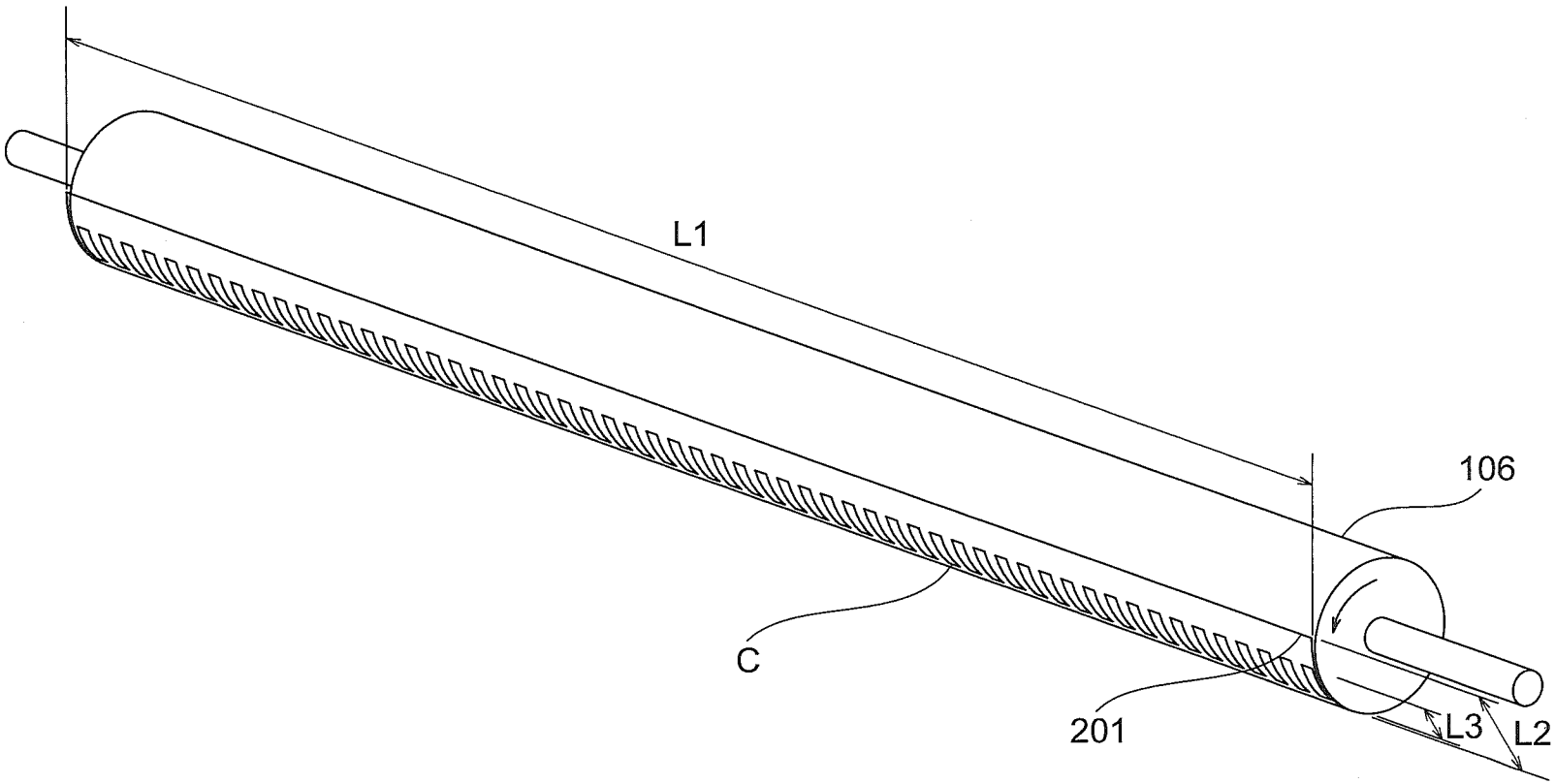
FIG. 4 is a perspective view showing a charge providing member and the supplying roller according to the first embodiment.

FIG. 4 is a perspective view showing the charge providing member 201 and the supplying roller 106. The charge providing member 201 has a length L1 which is the same as a length of a roller part of the supplying roller 106 in the axial direction. The charge providing member 201 has a predetermined width L2 along the surface of the supplying roller 106. A part of the charge providing member 201 having a width L3 (FIG. 4) contacts the supplying roller 106.

Referring back to FIG. 2, the toner cartridge 120 has a container 121 having a developer containing portion 125 storing the toner 110 as the developer. The developer containing portion 125 has an agitation bar 122 as an agitating member. The agitation bar 122 is rotatably provided in the developer containing portion 125. The agitation bar 122 extends in a longitudinal direction of the developer containing portion 125. A toner replenishing opening 124 as a replenishing opening is formed on a bottom of the container 121. The toner 110 in the developer containing portion 125 is supplied to the toner storage portion 131 via the replenishing opening 124. A shutter 123 is slidably provided in the container 121. The shutter 123 is slidable as shown in an arrow Q so as to open and close the toner replenishing opening 124. In a particular example, the toner replenishing opening 124 and the toner storage portion 131 of the toner cartridge 120 are disposed above the supplying roller 106.

<Toner>

The toner 110 (i.e., the developer) used in this embodiment will be described. The toner 110 includes toner mother particles containing at least binder resin, and external additives such as inorganic or organic fine powder. The toner 110 is stored in the toner cartridge 120. The toner 110 is negatively chargeable.

The binder resin is, for example, polyester resin, acrylic-styrene resin, epoxy resin, styrene-butadiene resin or the like. A coloring agent, a releasing agent and the like are added to the binder resin.

As for the releasing agent, for example, a paraffin wax, a carnauba wax or the like may be used. A content of the releasing agent is preferably in a range of 0.1-20 weight parts with respect to 100 weight parts of the binder resin, and is more preferably in a range of 0.5-12 weight parts with respect to 100 weight parts of the binder resin. Further, a plurality of kinds of waxes may be used in combination.

As for the coloring agent, a pigment, dye and or like generally used as the coloring agent for general black, yellow, magenta or cyan toner may be used singly, or a plurality of kinds may be used in combination. For example, carbon black, iron oxide, phthalocyanine blue, permanent brown FG, brilliant fast scarlet, pigment green B, rhodamine-B base, solvent red 49, solvent red 146, pigment blue 15:3, solvent blue 35, quinacridone, carmine 6B, disazo yellow or the like may be used as the coloring agent. An adding amount of the coloring agent added to the binder resin is preferably in a range of 2-25 weight parts with respect to 100 weight parts of the binder rein, and more preferably in a range of 2-15 weight parts with respect to 100 weight parts of the binder resin.

Further, additives such as charge control agent, conductivity adjusting agent, fluidity improving agent and cleaning property improving agent may be added to the binder resin.

As for the charge control agent, azo based complex charge control agent, a salicylic acid based complex charge control agent, a calixarene based charge control agent, a quaternary ammonium salt charge control agent or the like (i.e., conventional charge control agent) may be used singly, or a plurality of kinds may be used in combination. The content of the charge control agent is preferably in a range of 0.05-15 weight parts with respect to 100 weight parts of the binder resin, and more preferably in a range of 0.1-10 weight parts with respect to 100 weight parts of the binder resin.

The external additives are provided for enhancing environmental stability, charging stability, developing property, fluidity, preserving property or the like. For example, silica, titania, alumina or the like (i.e., conventional external additives) may be used singly, or a plurality of kinds may be used in combination. A content of the external additives is preferably in a range of 0.01-10 weight parts with respect to 100 weight parts of the binder resin, and is more preferably in a range of 0.05-8 weight parts with respect to 100 weight parts of the binder resin.

A manufacturing method of the toner is as follows. First, the following materials are mixed in a Henschel mixer: 100 weight parts of the binder resin (polyester resin, number average molecular weight Mn=3700, glass transition temperature Tg=62° C., softening temperature $T_{1/2}$=115° C.), 0.5 weight parts of the charge control agent "BONTRON E-84" (manufactured by Orient Chemical Industry Co., Ltd.), 5.0 weight parts of the coloring agent, and 4.0 weight parts of carnauba wax ("Powdered Carnauba Wax No. 1" manufactured by S. Kato and Co.) as the releasing agent. As for the coloring agent, carbon black is used for black toner, disazo yellow is used for yellow toner, carmine 6B is used for magenta toner, pigment blue 15:3 is used for cyan toner. The resulting material is molten and kneaded using a twin-screw extruder. The resulting material is cooled.

The resulting material is cracked using a cutter mill whose screen size was 2 mm. Then, the resulting material is crushed using a crusher with an impact plate ("Dispersion Separator" manufactured by Nippon Pneumatic Manufacturing Co., Ltd.). Further, the resulting material was classified using an air classifier, so that toner mother particles having a mean particle diameter of 6 μm were obtained.

Next, 3.0 weight parts of hydrophobic silica R972 (manufactured by Nippon Aerosil Ltd.) having a mean particle diameter of 16 nm as external additives is added to 1 kg (100 weight parts) of the toner mother particles. The resulting material is agitated using the Henschel mixer for 3 minutes. As a result, black toner, yellow toner, magenta toner and cyan toner are respectively obtained.

<Control System of Image Forming Apparatus>

FIG. 5 is a block diagram showing a control system of the image forming apparatus 10. In FIG. 5, a control unit 500 includes a not shown micro processor, ROM, RAM, I/O port, timer and the like. The control unit 500 receives printing data and control command from a not shown host device, and controls a sequence of a printing operation of the image forming apparatus 10.

A charge providing member power control unit 501 controls application of a voltage (i.e., a charge providing voltage) to the charge providing member 201 based on instruction from the control unit 500 so as to charge the surface of the charge providing member 201.

A charging roller power control unit 502 (i.e., a charging member power control unit) controls application of a charging voltage to the charging roller 102 based on instruction from the control unit 500 so as to uniformly charge the surface of the photosensitive drum 101 (FIG. 2).

An LED head control unit 503 (i.e., an exposure control unit) controls the LED head 23 based on instruction from the control unit 500 so as to expose the surface of the photosensitive drum 101 (FIG. 2) with light according to image data to thereby form a latent image thereon.

A developing roller power control unit 504 (i.e., a developer bearing body power control unit) controls application of a developing voltage to the developing roller 104 based on instruction from the control unit 500 so as to develop the latent image on the photosensitive drum 101 (FIG. 2).

A supplying roller power control unit 506 (i.e., a supplying member power control unit) controls application of a supplying voltage to the supplying roller 106 based on instruction from the control unit 500 so as to supply the toner to the developing roller 104.

A transfer roller power control unit 505 (i.e., a transfer power control unit) controls application of a transfer voltage to the transfer roller 30 based on instruction from the control unit 500 so as to transfer the toner image from the surface of the photosensitive drum 101 to the printing sheet 18 (FIG. 1).

In this regard, the charge providing member power control unit 501, the charging roller power control unit 502, the LED head control unit 503, the developing roller power control unit 504, the supplying roller power control unit 506 and the transfer roller power control unit 505 are provided for each of the image forming units 12K, 12Y, 12M and 12C, and perform controlling of each image forming unit 12. For convenience in explanation, the control units 501-506 are respectively shown by single blocks in FIG. 5.

A charge providing member power source 511 applies a direct voltage (i.e., the charge providing voltage) to the charge providing member 201 as indicated by a mark V1 in FIG. 3 under the control of the charge providing member power control unit 501. A charging roller power source 512 (i.e., a charging member power source) applies a direct voltage (i.e., the charging voltage) to the charging roller 102 under the control of the charging roller power control unit 502.

A developing roller power source 514 (i.e., a developer bearing body power source) applies a direct voltage (i.e., the developing voltage) of a negative polarity to the developing roller 104 as indicated by a mark V2 in FIG. 3 under the control of the developing roller power control unit 504. A positive polarity voltage power source 514*a* applies a direct voltage of a positive polarity to the developing roller 104 under the control of the developing roller power control unit 504.

A supplying roller power source 516 (i.e., a supplying member power source) applies a direct voltage (i.e., the supplying voltage) to the supplying roller 106 as indicated by a mark V3 in FIG. 3 under the control of the supplying roller power control unit 506. A transfer roller power source 515 (i.e., a transfer power source) applies a direct voltage (i.e., the transfer voltage) to the transfer roller 30 under the control of the transfer roller power control unit 505.

The ID motor 507 drives the photosensitive drum 101 to rotate. The rotation of the photosensitive drum 101 is transmitted to the developing roller 104 and the supplying roller 106 via a power transmission mechanism. The charging roller 102 and the transfer roller 30 rotate following the rotation of the photosensitive drum 101. The ID motor 507 is provided for each of the image forming units 12K, 12Y, 12M and 12C.

The conveying motor 508 drives the respective rollers of the medium feeding unit 13, the medium ejection unit 14 and the medium inverting unit 15 to rotate so as to feed the printing sheet 18 from the medium cassette 11 and convey the printing sheet 18 along the conveying path.

The fixing control unit 509 performs ON/OFF control of the heater 39 of the fixing unit 17 so as to keep constant a fixing temperature based on a detected temperature of the thermistor 38.

<Operation of Image Forming Apparatus>

An operation of the image forming apparatus 10 will be described with reference to FIGS. 1 and 5.

When the control unit 500 of the image forming apparatus 10 receives print command and image data from a host device such as a personal computer, the control unit 500 starts a feeding operation of the printing sheet 18.

As shown in FIG. 1, the pickup roller 19*a* and the feeing roller 19*b* feed the printing sheets 18 one by one out of the medium cassette 11 in the direction shown by the arrow A. The conveying rollers 19*c* and 19*d* and the conveying rollers 19*e* and 19*f* convey the printing sheet 18 in the direction shown by the arrow B toward the image forming section 22, while correcting the skew of the printing sheet 18.

As the printing sheet 18 reaches the image forming section 22, the transfer belt 27 (driven by the rotation of the drive roller 28) holds the printing sheet 18, and conveys the printing sheet 18 in the direction shown by the arrow T.

The printing sheet 18 held on the transfer belt 27 reaches a nip portion between the photosensitive drum 101 of the image forming unit 12*k* and the transfer roller 30. The transfer roller 30 is applied with the transfer voltage (for example, +3000V) by the transfer roller power source 515. With the transfer voltage, a black toner image formed on the photosensitive drum 101 is transferred to the printing sheet 18.

Then, the printing sheet 18 is further conveyed by the transfer belt 27 in the direction shown by the arrow T, and passes the image forming units 12Y, 12M and 12C. A yellow toner is transferred from the photosensitive drum 101 of the image forming unit 12Y to the printing sheet 18 in a similar manner to the black toner. Similarly, a magenta toner is transferred from the photosensitive drum 101 of the image forming unit 12M to the printing sheet 18, and a cyan toner is transferred from the photosensitive drum 101 of the image forming unit 12C to the printing sheet 18.

The printing sheet 18 to which the toner images of the respective colors are transferred is further conveyed in the direction shown by the arrow D to reach the fixing unit 17. In the fixing unit 17, the printing sheet 18 is inserted into the nip portion between the fixing roller 36 and the pressure roller 37 rotating respectively in directions shown by arrows E and F. The surface temperature of the heating roller 36 is maintained by the fixing control unit 509. The toner is molten by being heated by the heating roller 36. The molten toner is fixed to the printing sheet 18 by being pressed by the heated roller 36 and the pressure roller 37.

The printing sheet 18 to which the toner image is fixed is conveyed by the conveying rollers 19*g* and 19*h* of the medium ejection unit 14 in the direction shown by an arrow G, and is ejected outside the image forming apparatus 10. The ejected printing sheet 18 is placed on the stacker portion 24.

In the case of a double-side printing mode, the medium 18 to which the toner image has been fixed is conveyed in the direction shown by an arrow H by the switching guide 20, the conveying rollers 19*k* and 19*l* and the conveying rollers 19*x* and 19*w*. The printing sheet 18 is temporarily conveyed into the retreat path. Then, the printing sheet 18 is conveyed in the direction shown by an arrow I by the switching guide 21 and the conveying rollers 19*w* and 19*x* into the return path.

Then, the printing sheet 18 is conveyed along the return path as shown by arrows a, b and c by the conveying rollers 19*m*, 19*n*, 19*o*, 19*p*, 19*q*, 19*r*, 19*s*, 19*t*, 19*u* and 19*v*. The printing sheet 18 reaches the conveying roller 19*c* and 19*d* of the medium feeding unit 13, and is conveyed in the direction shown by the arrow B by the conveying rollers 19*c* and 19*d* to the image forming section 22. In the image forming section 22, a toner image is formed on a back surface (i.e., an opposite surface to the surface on which the toner image has been fixed) of the printing sheet 18. Then, the fixing of the toner image and the ejection of the printing sheet 18 are performed as described above.

<Operation of Image Forming Unit>

Figure 6:
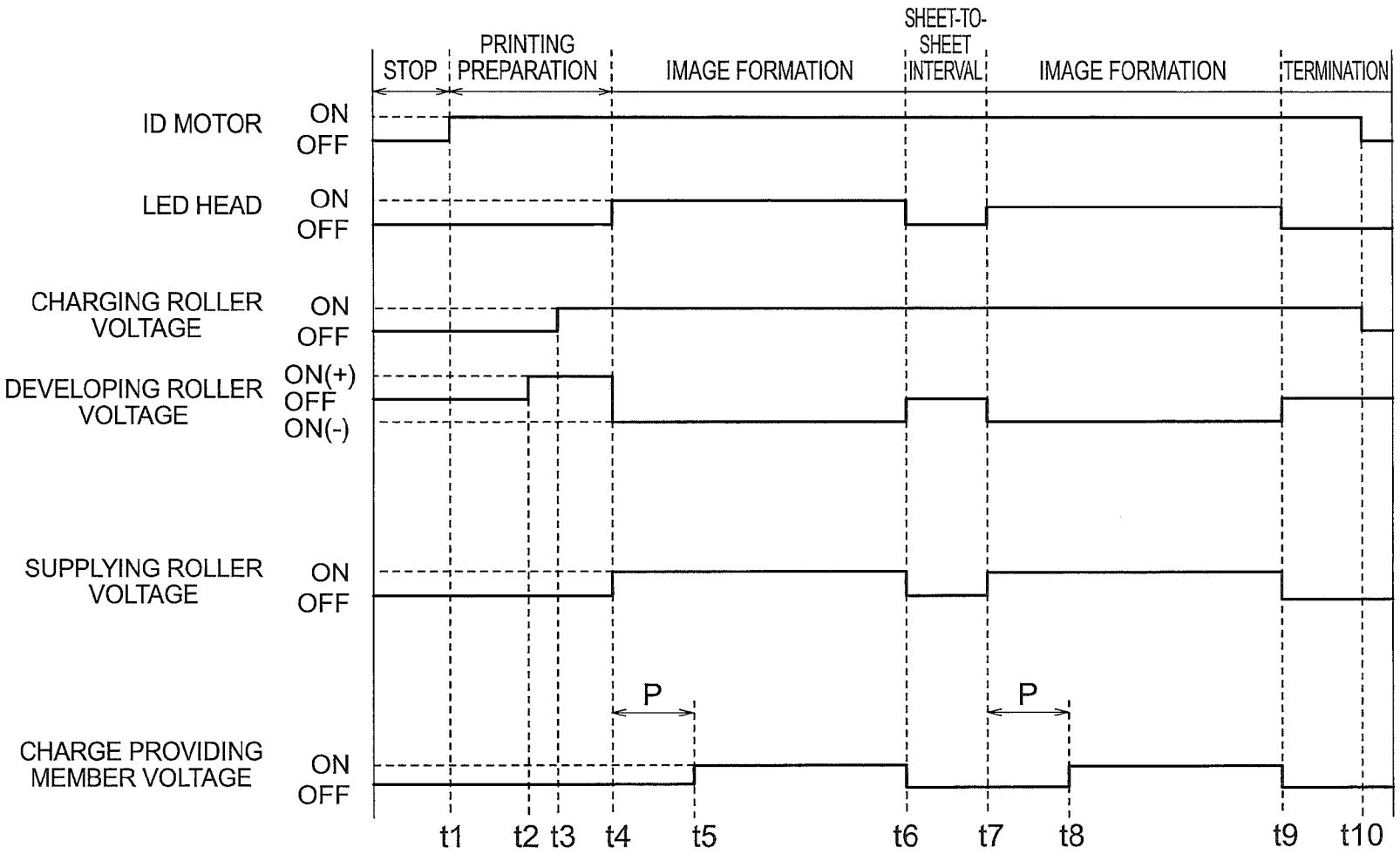
FIG. 6 is a timing chart showing an operation of an image forming unit according to the first embodiment.

An operation of the image forming unit 12 will be described with reference to FIGS. 2, 5 and 6. FIG. 6 is a timing chart showing the operation of the image forming unit 12.

The control unit 500 starts a printing preparation operation (t1) at a predetermined timing while the printing sheet 18 is being conveyed in the direction B (FIG. 1) by the conveying rollers 19*c*, 19*d*, 19*e* and 19*f*. The control unit 500 drives the ID motor 507. The photosensitive drum 101 rotates in the direction shown by the arrow R at a constant circumferential speed. As the photosensitive drum 101 rotates, the charging roller 102, the developing roller 104, the supplying roller 106 and the transfer roller 30 also rotate.

Then, the developing roller power control unit 504 causes the positive polarity voltage power source 514*a* to apply a voltage of positive polarity (for example, +200V) to the developing roller 104 (t2) in response to instruction from the control unit 500.

Next, the charging roller power control unit 502 causes the charging roller power source 512 to apply the charging voltage (for example, −1050V) to the charging roller 102 (t3) in response to instruction from the control unit 500. The charging roller 102 charges the surface of the photosensitive drum 101 to, for example, −550V.

Then, the control unit 500 starts image formation based on print data. First, the developing roller power control unit 504 causes the developing roller power source 514 to apply the developing voltage of negative polarity (for example, −250V) to the developing roller 104. Further, the supplying roller power control unit 506 causes the supplying roller power source 516 to apply the supplying voltage (for example, −350V) to the supplying roller 106. The LED head control unit 503 causes the LED head 23 to emit light based on print data (t4).

An electric potential of an exposed part of the photosensitive drum 101 attenuates to −100V, and a latent image is formed on the photosensitive drum 101. The latent image formed on the surface of the photosensitive drum 101 is developed with the toner supplied from the supplying roller 106 to the developing roller 104 (t4-t6).

In this regard, when a time P for the developing roller 104 and the supplying roller 106 to rotate one turn (360 degrees) passed after the starting of application of the supplying voltage to the supplying roller 106 (t4), the charge providing member power control unit 501 causes the charge providing member power source 521 to apply the charge providing voltage to the charge providing member 201 (t5).

Then, the control unit 500 terminates light emission of the LED head 23 and terminates application of voltages to the developing roller 104, the supplying roller 106 and the charge providing member 201 (t6).

If there is a subsequent printing sheet 18, the control unit 500 waits for a time interval (t6-t7) corresponding to a sheet-to-sheet interval, and starts image formation (t7-t9) for a next page.

After the toner image of the next page is transferred to the printing sheet 18, the control unit 500 terminates driving of the LED head 23 and terminates application of voltages to the developing roller 104, the supplying roller 106 and the charge providing member 201 (t9).

If there is no subsequent printing sheet 18, the control unit 500 terminates driving the ID motor 507 and terminates application of the charging voltage to the charging roller 102 from the charging roller power source 512 (t10).

In this regard, the timing of application of the voltage to the charge providing member 201 (t5) is after the timing of application of the voltages to the developing roller 104 and the supplying roller 106 (t4). This is because, if the application of the voltage to the charge providing member 201 is performed at the same time as the application of the voltages to the developing roller 104 and the supplying roller 106, there is a possibility that the toner held on the surface of the supplying roller 106 may be excessively charged. For this reason, it is preferable that the application of the voltage to charge providing member 201 is started when the time P (required for the developing roller 104 and the supplying roller 106 to rotate one turn) passed after starting of the application of the voltages to the developing roller 104 and the supplying roller 106 (t4).

The reason why the voltage of positive polarity is applied to the developing roller 104 during the period t2-t4 is as follows. Before a part of the surface of the photosensitive drum 101 charged by the charging roller 102 reaches a nip portion between the photosensitive drum 101 and the developing roller 104, there is a possibility that the toner on the surface of the developing roller 104 may adhere to the photosensitive drum 101, since the surface potential the photosensitive drum 101 (except the charged part) is generally almost 0V. In other words, there is a possibility that the toner may be wasted uselessly. Further, when the toner charged by friction with the developing roller 104 and the supplying roller 106 reaches the nip portion between the developing roller 104 and the photosensitive drum 101, such a toner may adhere to the surface of the photosensitive drum 101.

For this reason, in this embodiment, the voltage of positive polarity is applied to the developing roller 104 during the period t2-t4 to thereby cause the toner (i.e., the negatively chargeable toner) to be attracted to the developing roller 104. With such an arrangement, the toner is prevented from adhering to the surface of the photosensitive drum 101. In this regard, it is also possible to start application of the voltage of the positive polarity to the developing roller 104 at the timing t1.

<Flow of Toner in Image Forming Unit>

A flow of the toner from the toner storage portion 131 to the photosensitive drum 101 of the image forming unit 12 will be described with reference to FIGS. 2 and 3.

In a state where the toner cartridge 120 is mounted to the developing unit 100, the shutter 123 (FIG. 2) of the toner cartridge 120 is slid in a direction shown by the arrow Q by an operation of a lever (not shown). The shutter 123 opens the toner replenishing opening 124. As the toner replenishing opening 124 is opened, the toner 110 in the container 121 of the toner cartridge 120 falls in the direction shown by an arrow V via the toner replenishing opening 124. The fallen toner is supplied to the toner storage portion 131 of the developing unit 100 via a toner receiving opening 130 formed on the upper part of the developing unit 100.

The supplying roller 106 is applied with the direct voltage Vsb (for example, −350V) by the supplying roller power source 516. The supplying roller 106 rotates in the direction shown by the arrow e so as to convey the toner 110 (supplied to the toner storage portion 131) to the developing roller 104.

The developing roller 104 is provided so as to tightly contact the photosensitive drum 101. The developing roller 104 is applied with the direct voltage Vdb (for example, −250V) by the developing roller power source 514. The developing roller 104 holds the toner 110 having been conveyed from the supplying roller 106, and conveys the toner 110 by rotating in the direction shown by an arrow f.

The developing blade 107 is pressed against the developing roller 104 at a downstream side of the supplying roller 106 in a rotating direction of the developing roller 104. During the rotation of the developing roller 104, the developing blade 107 forms a layer of the toner (i.e., a toner layer) on the surface of the developing roller 104. The toner (i.e., a regularly charged toner) forming the toner layer on the surface of the developing roller 104 is charged to, for example, almost −60V by friction with the developing roller 104, the supplying roller 106 and the developing blade 107.

An electric potential difference between the photosensitive drum 101 and the developing roller 104 generates electrical lines of force according to the latent image. Therefore, the charged toner 101 on the surface of the developing roller 104 adheres to the surface of a latent image part on the surface of the photosensitive drum 101 by electrostatic force. The latent image on the surface of the photosensitive drum 101 is reversely developed by the toner 110.

Further, the residual toner 110 remaining on the developing roller 104 (without being used for developing the latent image) is conveyed by the rotation of the developing roller 104 to the opposing portion β between the developing roller 104 and the supplying roller 106, and is collected by the supplying roller 106.

As shown in FIG. 3, the toner existing in a region on a downstream side of the opposing portion β between the developing roller 104 and the supplying roller 106 in the rotating direction of the supplying roller 106 (i.e., shown by the arrow e) is pressed by the supplying roller 106 and the charge providing member 201.

The toner existing in this region is charged by the charge providing member 201 applied with the direct voltage Vf. By the rotation of the supplying roller 106, the toner is conveyed to a further downstream side on the surface of the supplying roller 106 in the rotating direction of the supplying roller 106. The conveyed toner and a newly supplied toner from the toner storage portion 131 join each other. The joined toner is supplied to the developing roller 104, and is used for developing a latent image.

Referring back to FIG. 2, there is a case where a slight amount of the toner 110 remains on the surface of the photosensitive drum 101 after the transferring of the toner image. Such a residual toner 100 is removed by the cleaning blade 105. The cleaned photosensitive drum 101 is repeatedly used.

Further, during a continuous printing operation, there are cases where an excessively or insufficiently charged toner 110 may be transferred from the photosensitive drum 101 to a part of the surface of the transfer belt 27 (FIG. 1) where the printing sheet 18 is not held (i.e., a sheet-to-sheet interval). Such a toner is scraped off by the transfer belt cleaning blade 34 (FIG. 1) when the transfer belt 27 moves in a direction shown by arrows T and U. The toner scraped off by the transfer belt cleaning blade 34 is stored in the waste developer tank 35.

<Printing Tests>

Next, printing tests for confirming the effects of the charge providing member 201 of this embodiment will be described.

The cyan image forming unit 12C with the charge providing member 201 was mounted to the image forming apparatus 10. Using the image forming apparatus 10 as a test apparatus, cyan images were formed on the printing sheets 18 under room environment (i.e., at a temperature of 25° C. and a humidity of 50%).

A printing speed (equal to the circumferential speed of the photosensitive drum 101 and a conveying speed of the printing sheet 18) was set to 274 mm/s. The photosensitive drum 101 (30 mm in outer diameter), the charging roller 102 (11 mm in outer diameter), the developing roller 104 (16 mm in outer diameter) and the supplying roller 106 (16 mm in outer diameter) were rotated in directions respectively shown by arrows in FIG. 2. Further, the ratio of the circumferential speeds of the photosensitive drum 101, the charging roller 102, the developing roller 104 and the supplying roller 106 was set to 1:1:1.3:(1.3×0.7).

The charging voltage Vch applied to a metal shaft of the charging roller 102 was −1050V. The developing voltage Vdb applied to a metal shaft of the developing roller 104 was −250V. The supplying voltage Vsb applied to the supplying roller 106 was −350V. The transfer voltage Vtr applied to the transfer roller 30 was +3000V. The voltages Vch, Vdb, Vsb and Vtr were direct voltages.

Surface potentials VA1 and VA2 of an exposed part and a non-exposed part of the surface of the photosensitive drum 101 were measured. As a result of measurement, the surface potential VA1 of the exposed part was −50V, and the surface potential VA2 of the non-exposed part was −550V.

The charge providing member 201 was made of a plate spring composed of phosphor bronze. The charge providing member 201 had the length L1 (FIG. 4) of 210 mm, and the width L2 (FIG. 4) of 10 mm. A contact region between the charge providing member 201 and the supplying roller 106 had a substantially rectangular shape, and had the length L1 of 210 mm and the width L3 of 6 mm. An area of the contact region was 1260 $mm^2$ (i.e., L1×L3=210 mm×6 mm).

A probe "MODEL 555P-4" (manufactured by TREK Incorporated) of a surface potential meter "MODEL 344" (manufactured by TREK Incorporated) was set to a position shown by an arrow I in the image forming unit 12 so as to measure respective surface potentials of the supplying roller 106, the toner layer formed thereon and the charge providing member 201.

Then, electrical connections between the charge providing member 201 and the charge providing member power source 511 were disconnected so as not to apply a voltage to the charge providing member 201. In this state, the printing sheet 18 was longitudinally fed so that shorter edges of the paper became a leading end and a trailing end. A standard paper of A4 size (to be more specific, "Oki Excellent White Paper" having the basis weight of 80 g/$m^2$) was used as the printing sheet 18. Using the image forming apparatus 10, a white image was formed on the printing sheet 18 without causing the LED head 23 to emit light. A measured value VB of the surface potential meter during image formation was −400V. Since the supplying voltage Vsb applied to the supplying roller 106 was −350V, it is understood that a voltage Vtn of the toner layer on the surface of the supplying roller 106 was −50V.

Figure 7:
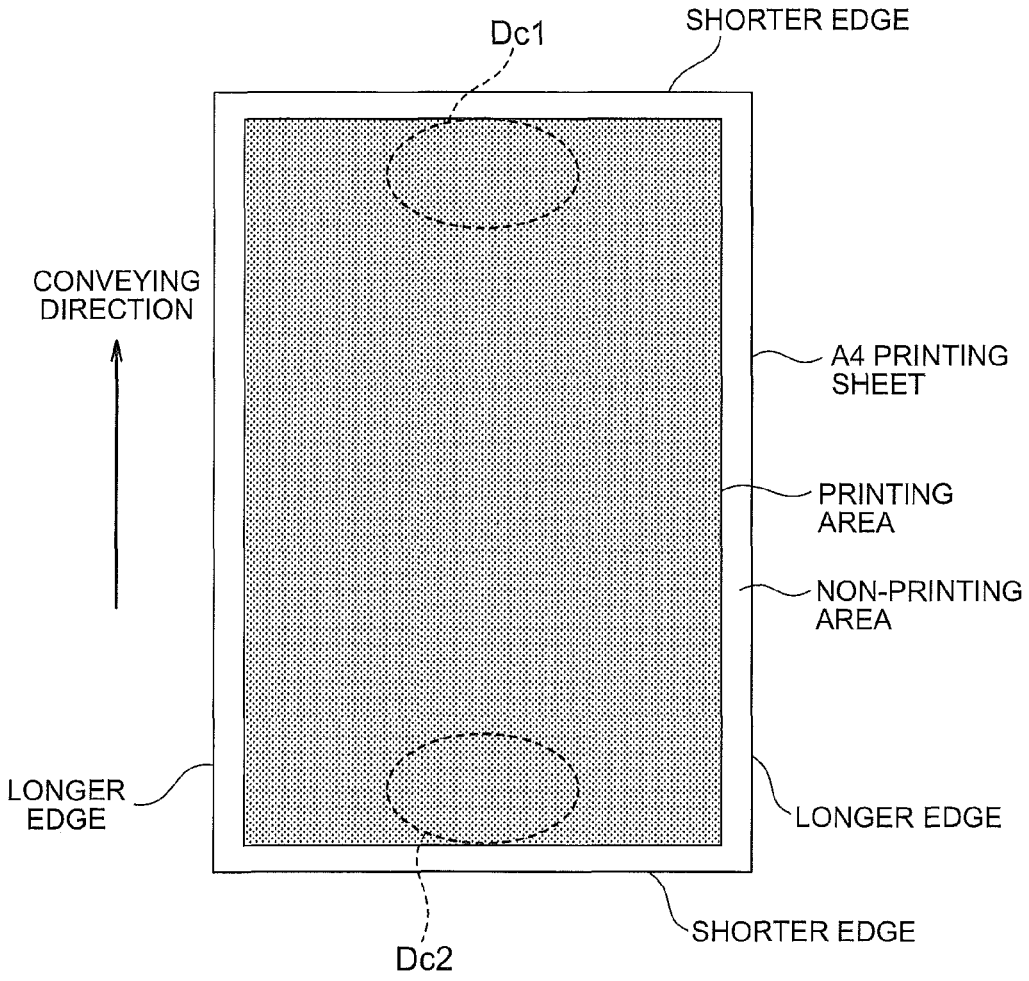
FIG. 7 is a diagram showing measurement positions of image densities.

Next, the charge providing member 201 and the charge providing member power source 511 were electrically connected, and a voltage (direct voltage) Vf of −800V was applied to the charge providing member 201. In this state, images as shown in FIG. 7 were continuously printed on 500 pages while setting the sheet-to-sheet interval (i.e., an interval from a trailing end of the printing sheet 18 to a leading end of the next printing sheet 18) to 60 mm. The image was formed on a whole printing area of the printing sheet 18 except margin areas (non-printing areas) of 5 mm from four edges of the printing sheet 18. In other words, an area ratio of the image shown in FIG. 7 was 100%. After the images are printed on 500 pages, the toner was sucked using a suction-type charge amount measuring device "MODEL210HS-3" (manufactured by TREK Incorporated) from the toner layer on the developing roller 104, and an electric charge (μC) of the toner was measured. Further, weight of the toner sucked upon measurement of the electric charge was measured using an electric balance "CP225D" manufactured by Sartorius Co., Ltd. A charge amount (μC/g) of the toner was obtained by dividing the measured electric charge (μC) by the measured weight (g).

Similarly, the voltage Vf was varied to −800V, −700V, −600V, −500V, −400V, −300V, 0V and +100V, and the images shown in FIG. 7 were printed on 500 pages for each voltage Vf. For each voltage Vf, an upper part density Dc1 and a lower part density Dc2 of the 500th printed image were measured. As shown in FIG. 7, the upper part density Dc1 was measured at a center portion of a leading end of the printed image (i.e., the printing area) in the conveying direction of the printing sheet 18. The lower part density Dc2 was measured at a center of a trailing end of the image in the conveying direction of the printing sheet 18. The densities Dc1 and Dc2 were measured using a density meter "X-Rite 528 (Status I)" manufactured by X-rite incorporated. The densities Dc1 and Dc2 were measured in such a manner that the printing sheet 18 to be measured is placed on ten stacked sheets of unused "Oki Excellent White Paper". In this regard, the densities Dc1 and Dc2 are collectively referred to as the image densities Dc.

The measured image density Dc was evaluated as follows.

When the image density Dc was greater than or equal to 1.3, the image density Dc was evaluated as "good". In other words, the printed image had a sufficient density.

When the image density Dc was in a range of 1.20≤Dc≤1.30, the image density Dc was evaluated as "fair". In other words, the printed image had a slightly low density, and gave an impression that repeatability was insufficient.

When the image density Dc was less than 1.20, the image density Dc was evaluated as "poor". In other words, the printed image had a low density, and was at an unacceptable level.

Figure 8:
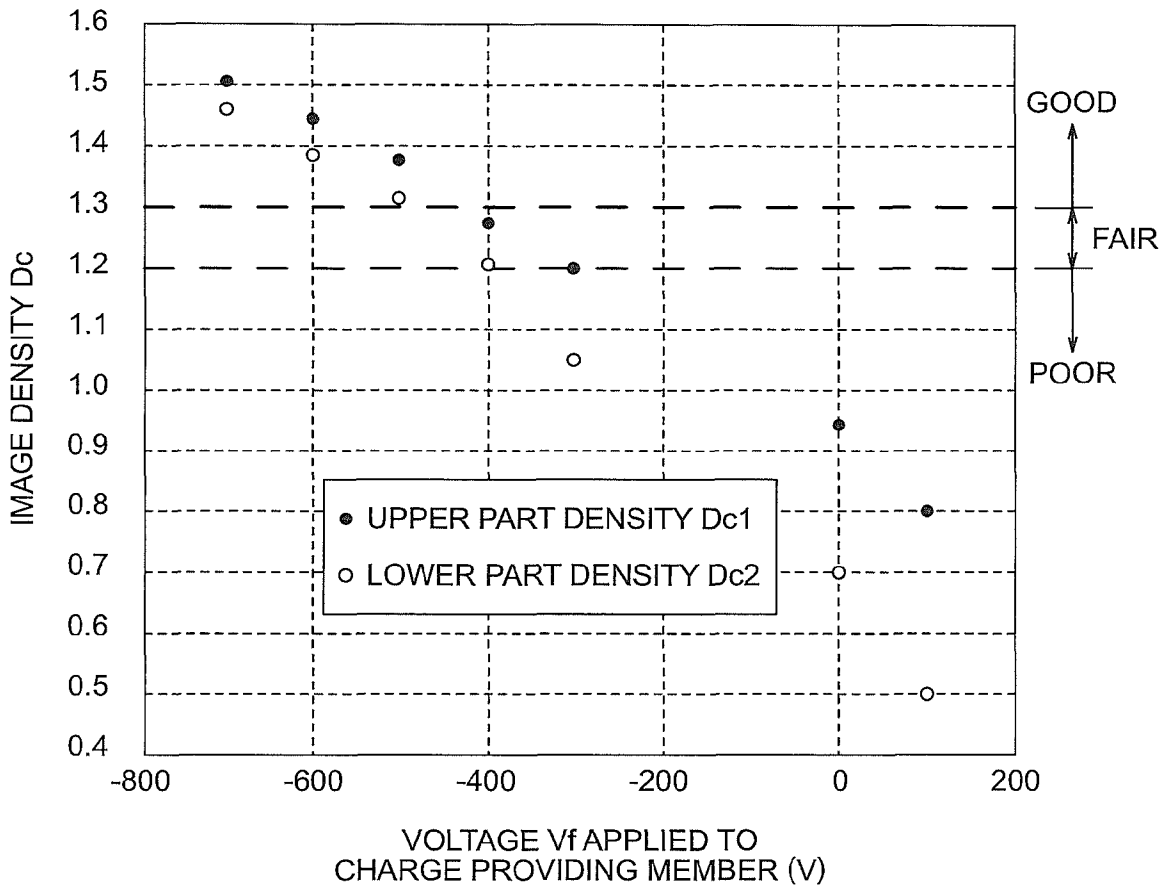
FIG. 8 is a graph showing measurement results of image densities of an upper part and a lower part of a printed image.

TABLE 1 shows measurement results of the upper part density Dc1 and the lower part density Dc2. FIG. 8 is a graph illustrating the measurement results shown in TABLE 1.

TABLE 1

| | IMAGE DENSITY Dc | | QUALITY EVALUATION | | | |
|---|---|---|---|---|---|---|
| Vf (V) | Dc1 | Dc2 | DENSITY EVALUATION | IMAGE BLURRING | STAIN | TOTAL EVALUATION |
| +100 | 0.80 | 0.50 | poor | poor | good | poor |
| 0 | 0.94 | 0.70 | poor | poor | good | poor |
| −300 | 1.19 | 1.05 | poor | poor | good | poor |
| −400 | 1.27 | 1.20 | fair | good | good | fair |
| −500 | 1.37 | 1.31 | good | good | good | good |
| −600 | 1.44 | 1.38 | good | good | good | good |
| −700 | 1.50 | 1.45 | good | good | good | good |
| −800 | 1.55 | 1.51 | good | good | poor | poor |

Figure 9:
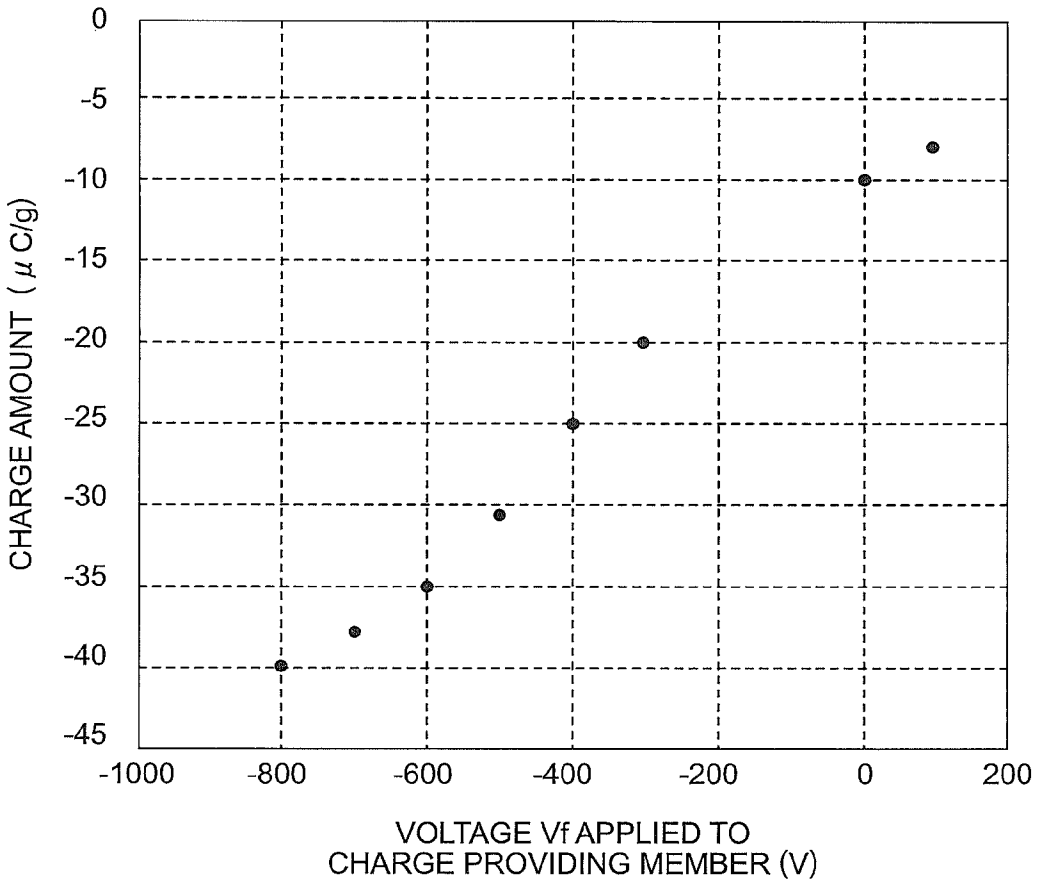
FIG. 9 is a graph showing measurement results of an electric charge amount of a toner.

TABLE 2 shows measurement results of the charge amount of the toner (μC/g). FIG. 9 is a graph illustrating the measurement results shown in TABLE 2.

TABLE 2

| Vf (V) | CHARGE AMOUNT (μC/g) |
|---|---|
| +100 | −8 |
| 0 | −10 |
| −300 | −20 |
| −400 | −25 |
| −500 | −31 |
| −600 | −35 |
| −700 | −38 |
| −800 | −40 |

In the results shown in TABLE 1 and FIG. 8, stains were found when the voltage Vf=−800V. More specifically, the toner adhered to the non-printing area (i.e., the margin area) of the printing sheet 18. The reason is thought to be because the toner was excessively charged during image formation. Since the toner was excessively charged, an electric potential of the toner layer on the developing roller 104 became higher than the surface potential of the photosensitive drum 101, with the result that the toner adhered to the non-exposed part of the photosensitive drum 101. Further, from the results shown in TABLE 2, it is understood that the toner is negatively charged, and the charge amount of the toner varies depending on the voltage Vf.

When the voltage Vf was in a range from −300V to +100V, image density was low, and image blurring was observed. This is thought to be because the charge amount of the toner was low, and an amount of the toner supplied to the developing roller 104 became insufficient.

In contrast, when the voltage Vf was in a range from −700V to −400V, a sufficient image density was obtained. Further, neither image blurring nor stain was observed. That is, an excellent image was obtained.

In the range of the voltage Vf from −700V to −400V, the voltage Vf is of the same polarity as the toner, and an absolute value of the voltage Vf is greater than or equal to an absolute value of a sum (−400V) of the supplying voltage Vsb applied to the supplying roller 106 (−350V) and the electric potential of the toner layer (−50V).

More specifically, in the range of the voltage Vf from −700V to −400V, the voltage Vf is of the same polarity as the toner, and an absolute value of the voltage Vf is greater than or equal to an absolute value of a sum (−400V) of the supplying voltage Vsb applied to the supplying roller 106 (−350V) and the electric potential of the toner layer (−50V). Furthermore, the absolute value of the voltage Vf is less than or equal to an absolute value of 2 times the supplying voltage Vsb applied to the supplying roller 106 (−700V).

Accordingly, it is understood that decrease in image density after the continuous printing operation can be suppressed, and image blurring and stain can be prevented when the charge providing member 201 faces (more specifically, contacts) the surface of the supplying roller 106 and is applied with the voltage Vf of the same polarity as the toner, and the absolute value of the voltage Vf is greater than the absolute value of the sum of the supplying voltage Vsb applied to the supplying roller 106 and the electric potential of the toner layer (more preferably, less than or equal to an absolute value of 2 times the supplying voltage Vsb applied to the supplying roller 106).

COMPARISON EXAMPLE 1-1

Figure 10:
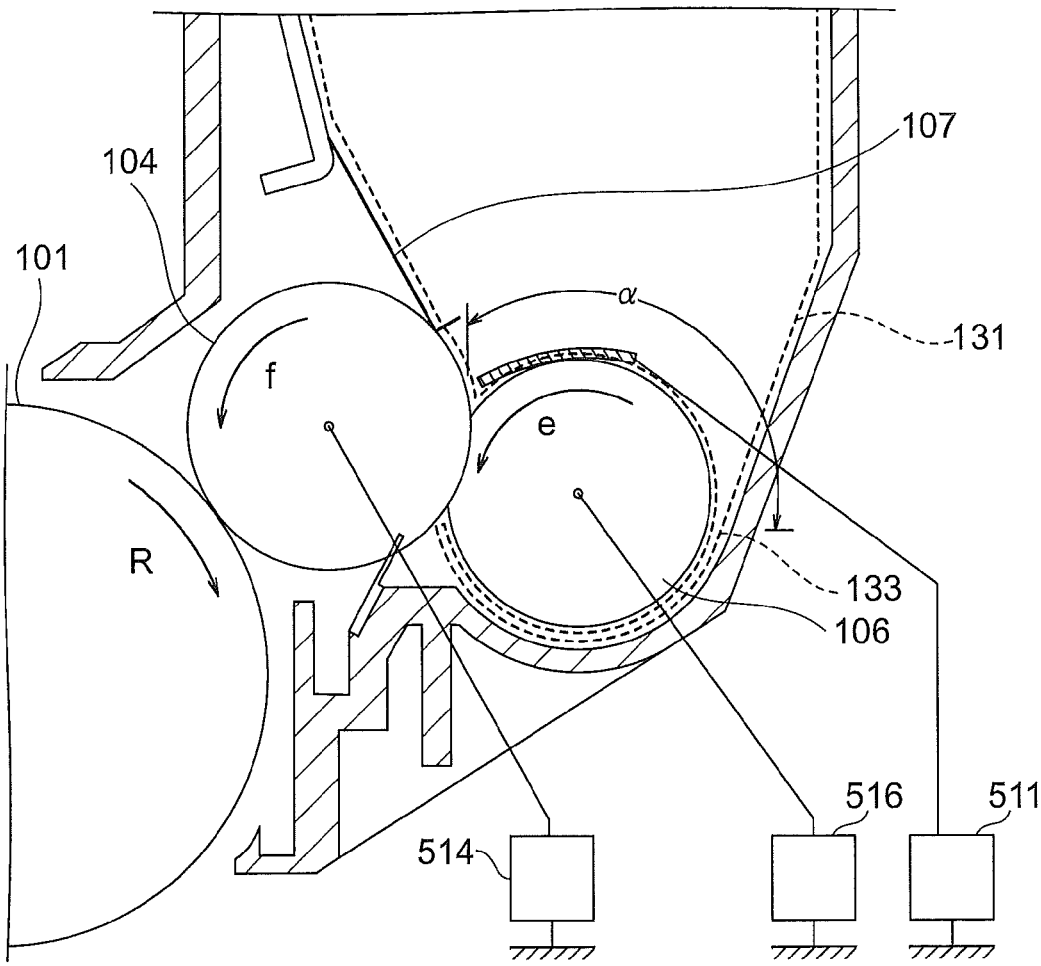
FIG. 10 is a sectional view showing a main part of an image forming unit according to Comparison Example 1-1.

FIG. 10 is a schematic view showing a main part of an image forming unit according to Comparison Example 1-1. In the image forming unit according to Comparison Example 1-1, the charge providing member 201 is disposed in a toner supplying region α above the supplying roller 106. The toner supplying region α is a region where the toner is newly supplied to the supplying roller 106 from the toner storage portion 131. Other components of the image forming unit of Comparison Example 1-1 is the same as those of the image forming unit 12 (FIGS. 2 and 3) of the first embodiment.

The image forming unit of Comparison Example 1-1 is mounted to the image forming apparatus, and the images (FIG. 7) were printed on 500 pages on the above described conditions. As a result, stains were found when the voltage Vf was in a range from −400V to −800V. This is thought to be because the toner newly supplied from the toner storage portion 131 to the supplying roller 106 was excessively charged by the charge providing member 201. Further, when the voltage Vf was in a range from +100V to −400V, image densities were low, and the printed images were at an unacceptable level.

COMPARISON EXAMPLE 1-2

In Comparison Example 1-2, the charge providing member 201 was removed from the image forming unit (FIGS. 2 and 3) of the first embodiment, and the image forming unit without the charge providing member 201 was mounted to the image forming apparatus. Using such an image forming apparatus, the images (FIG. 7) were printed on 500 pages on the above described conditions. As described above, the voltage Vf applied to the charge providing member 201 was set to −800V, and the supplying voltage Vsb applied to the supplying roller 106 was set to −350V. The upper part density Dc1 and the lower part density Dc2 of the 500th printed image were measured.

As a result, the upper part density Dc1 was 1.20, and the lower part density Dc2 was 1.05. Both of the densities Dc1 and Dc2 were low, and the printed image was at an unacceptable level.

COMPARISON EXAMPLE 1-3

In Comparison Example 1-3, the charge providing member 201 was removed from the image forming unit (FIGS. 2 and 3) of the first embodiment, and the image forming unit without the charge providing member 201 was mounted to the image forming apparatus. Using such an image forming apparatus, the images (FIG. 7) were printed on 500 pages on the above described conditions. As described above, the voltage Vf applied to the charge providing member 201 was set to −800V. The supplying voltage Vsb applied to the supplying roller 106 was set to −500V. The upper part density Dc1 and the lower part density Dc2 of the 500th printed image were measured.

As a result, the upper part density Dc1 was 1.40, and the lower part density Dc2 was 1.35. Stains were found in the printed images, and the printed image was at an unacceptable level.

As described above, in the printing tests using the image forming units of Comparison Examples 1-1 to 1-3, densities of the printed images were lower than those of the first embodiment, or stains were observed.

Therefore, it is understood that excellent image is obtained by providing the charge providing member 201 so as to face the surface of the supplying roller 106 at a downstream side of the opposing portion between the supplying roller 106 and the developing roller 104 and on an upstream side of the toner storage portion 131 as shown in FIG. 3.

The reason is thought to be follows. The charge providing member 201 provides an electric charge to the toner collected from the developing roller 104 by the supplying roller 106, and therefore the collected toner (held on the supplying roller 106) can be prevented from insufficiently charged. At the same time, the toner newly supplied to the supplying roller 106 from the toner storage portion 131 can be prevented from excessively charged. Therefore, insufficient and excessive supply of the toner to the developing roller 104 can be prevented.

In this regard, although the above described printing tests of the first embodiment and Comparison Examples were performed using the cyan image forming units, the same results were obtained when black, yellow and magenta image forming units are used.

<Effects>

As described above, according to the first embodiment, the charge providing member 201 is provided so as to face the surface of the supplying roller 106. In the rotating direction of the supplying roller 106, the charge providing member 201 is disposed on the downstream side of the opposing portion β between the supplying roller 106 and the developing roller 104, and on the upstream side of the toner supplying region α where the toner storage portion 131 supplies the toner to the supplying roller 106. With such a configuration, insufficient charging of the collected toner held on the supplying roller 106 can be prevented, and excessive charging of the toner newly supplied to the supplying roller 106 from the toner storage portion 131 can be prevented. Therefore, appropriately charged toner can be supplied to the developing roller 104, and excellent printing image can be obtained.

Further, decrease in image density after the continuous printing can be suppressed and image blurring or stain can be prevented by a configuration in which the voltage Vf of the same polarity as the toner is applied to the charge providing member 201, and in which the absolute value of the voltage Vf is greater than or equal to the absolute value of the sum of the supplying voltage Vsb applied to the supplying roller 106 and the electric potential of the toner layer.

Second Embodiment

<Configuration of Image Forming Unit>

Figure 11:
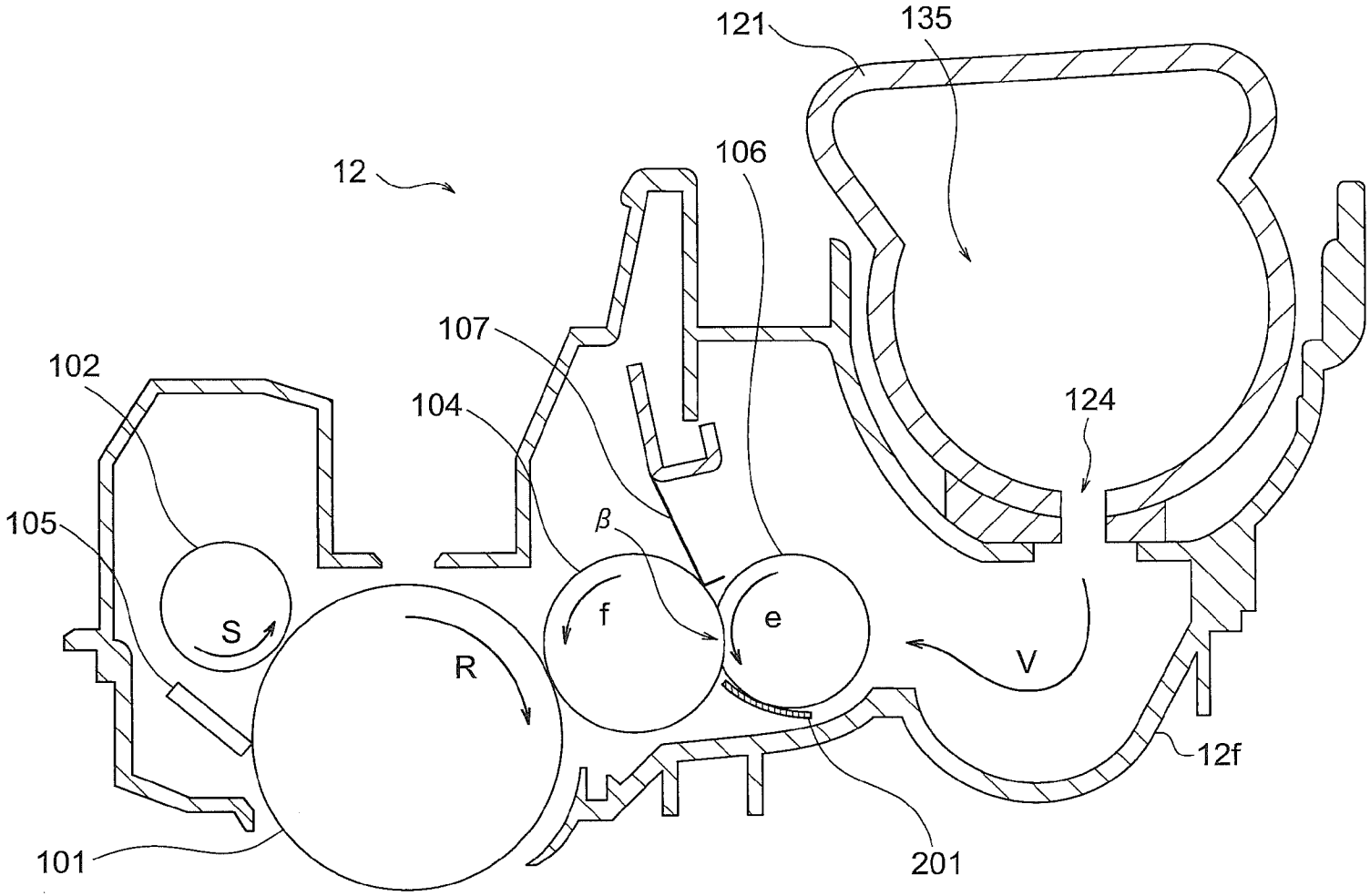
FIG. 11 is a sectional view showing a configuration of an image forming unit according to the second embodiment of the present invention.

FIG. 11 is a sectional view showing a configuration of a image forming unit 12 according to the second embodiment of the present invention. In the image forming unit 12 of the second embodiment, a toner replenishing opening 124 of the toner cartridge 120 is not disposed above the supplying roller 106, but is disposed on a side with respect to the supplying roller 106. The toner replenished by the toner cartridge 120 is supplied to the supplying roller 106 as schematically illustrated using an arrow V in FIG. 11.

FIG. 12 is an enlarged view showing a part of the image forming unit 12 of FIG. 11 including the supplying roller 106 and its surroundings. In the second embodiment, the toner storage portion 131 (i.e., the region from which the toner is newly supplied to the supplying roller 106) extends upstream in the rotating direction of the supplying roller 106, as compared with the toner storage portion 131 of the first embodiment (FIG. 3). In other words, the toner storage portion 131 extends downward in FIG. 12 as compared with the toner storage portion 131 of the first embodiment. Therefore, the terminal end of the collected toner conveying portion 133 (i.e., an opposite end to the opposing β portion between the supplying roller 106 and the developing roller 104) is displaced upstream in the rotating direction of the supplying roller 106, as compared with the collected toner conveying portion 133 of the first embodiment. Other components of the image forming unit 12 are the same as those of the image forming unit 12 of the first embodiment.

<Printing Tests>

The cyan image forming unit 12 of the second embodiment was mounted to the image forming apparatus, and printing tests were performed on the same conditions as described in the first embodiment. As a result, the same results as described in the first embodiment were obtained.

In the second embodiment, the charge providing member 201 is provided so as to face the surface of the supplying roller 106. In the rotating direction of the supplying roller 106, the charge providing member 201 is disposed on a downstream side of the opposing portion β between the supplying roller 106 and the developing roller 104 and on an upstream side of the toner supplying region α where the toner storage portion 131 supplies the toner to the supplying roller 106. The voltage Vf of the same polarity as the toner is applied to the charge providing member 201, and the absolute value of the voltage Vf is greater than or equal to the absolute value of the sum of the supplying voltage Vsb applied to the supplying roller 106 and the electric potential of the toner layer. With such a configuration, decrease in image density after the continuous printing operation can be suppressed, and image blurring and stain can be prevented.

COMPARISON EXAMPLE 2-1

Figure 13:
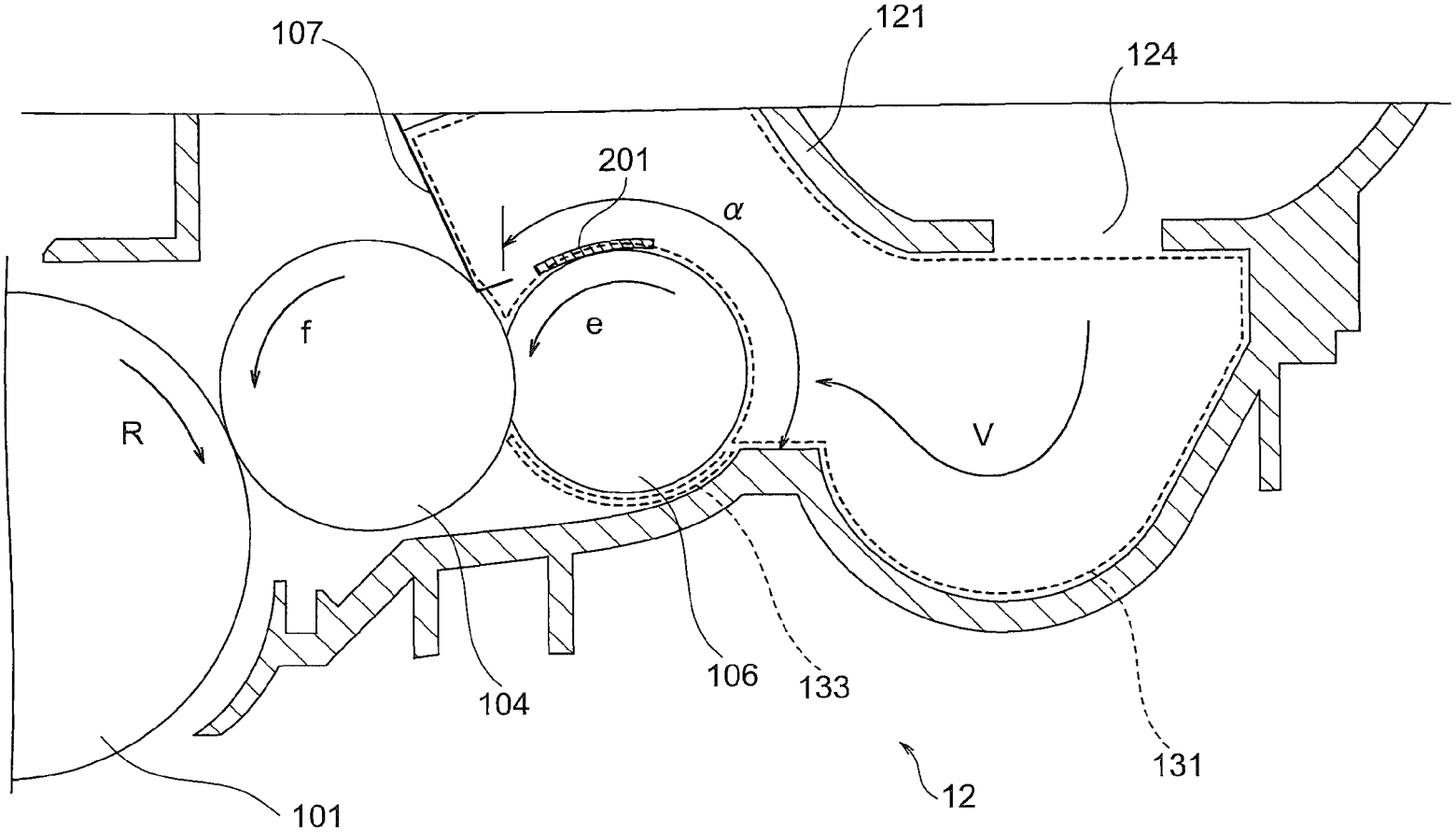
FIG. 13 is a sectional view showing a main part of the image forming unit according to Example 2-1.

FIG. 13 shows a main part of an image forming unit according to Comparison Example 2-1. In the image forming unit of Comparison Example 2-1, the charge providing member 201 is disposed above the supplying roller 106. In other words, the charge providing member 201 is disposed in the toner storage portion 131 (more specifically, in the toner supplying region α) Other components of the image forming unit are the same as those of the image forming unit 12 (FIGS. 11 and 12) of the second embodiment.

The image forming unit of Comparison Example 2-1 is mounted to the image forming apparatus, and printing tests were performed as described above. As a result, stains were found in the printed images when the voltage Vf is in a range from −400V to −800V. Further, when the voltage Vf is in a range from +100 to −300V, the image densities were low, and printed images were at an unacceptable level.

COMPARISON EXAMPLE 2-2

In Comparison Example 2-2, the charge providing member 201 was removed from the image forming unit (FIGS. 11 and 12) of the second embodiment, and the image forming unit without the charge providing member 201 was mounted to the image forming apparatus. Using such an image forming apparatus, the images (FIG. 7) were printed on 500 pages on the above described conditions. As described above, the voltage Vf applied to the charge providing member 201 was set to −800V, and the supplying voltage Vsb applied to the supplying roller 106 was set to −350V. The upper part density Dc1 and the lower part density Dc2 of the 500th printed image were measured.

As a result, the upper part density Dc1 and the lower part density Dc2 were low, and the printed image was at an unacceptable level as in the above described Comparison Example 1-2.

COMPARISON EXAMPLE 2-3

In Comparison Example 2-3, the charge providing member 201 was removed from the image forming unit (FIGS. 11 and 12) of the second embodiment, and the image forming unit without the charge providing member 201 was mounted to the image forming apparatus. Using such an image forming apparatus, the images (FIG. 7) were printed on 500 pages on the above described conditions. As described above, the voltage Vf applied to the charge providing member 201 was set to −800V. The supplying voltage Vsb applied to the supplying roller 106 was set to −500V. The upper part density Dc1 and the lower part density Dc2 of the 500th printed image were measured.

As a result, stains were found in the printed images, and the printed image was at an unacceptable level as in the above described Comparison Example 1-3.

COMPARISON EXAMPLE 2-4

Figure 14:
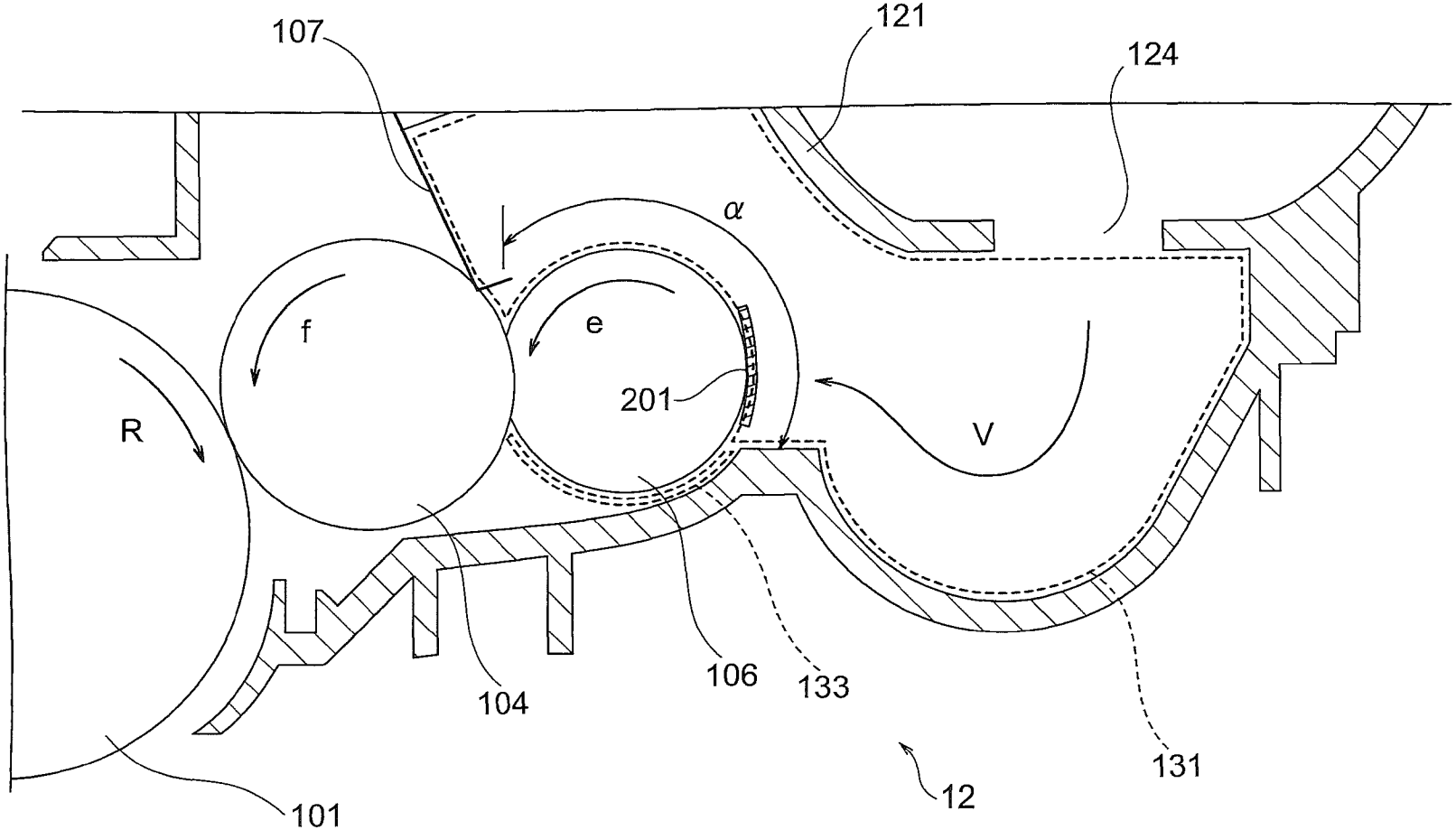
FIG. 14 is a sectional view showing a main part of the image forming unit according to Example 2-4.
Figure 15:
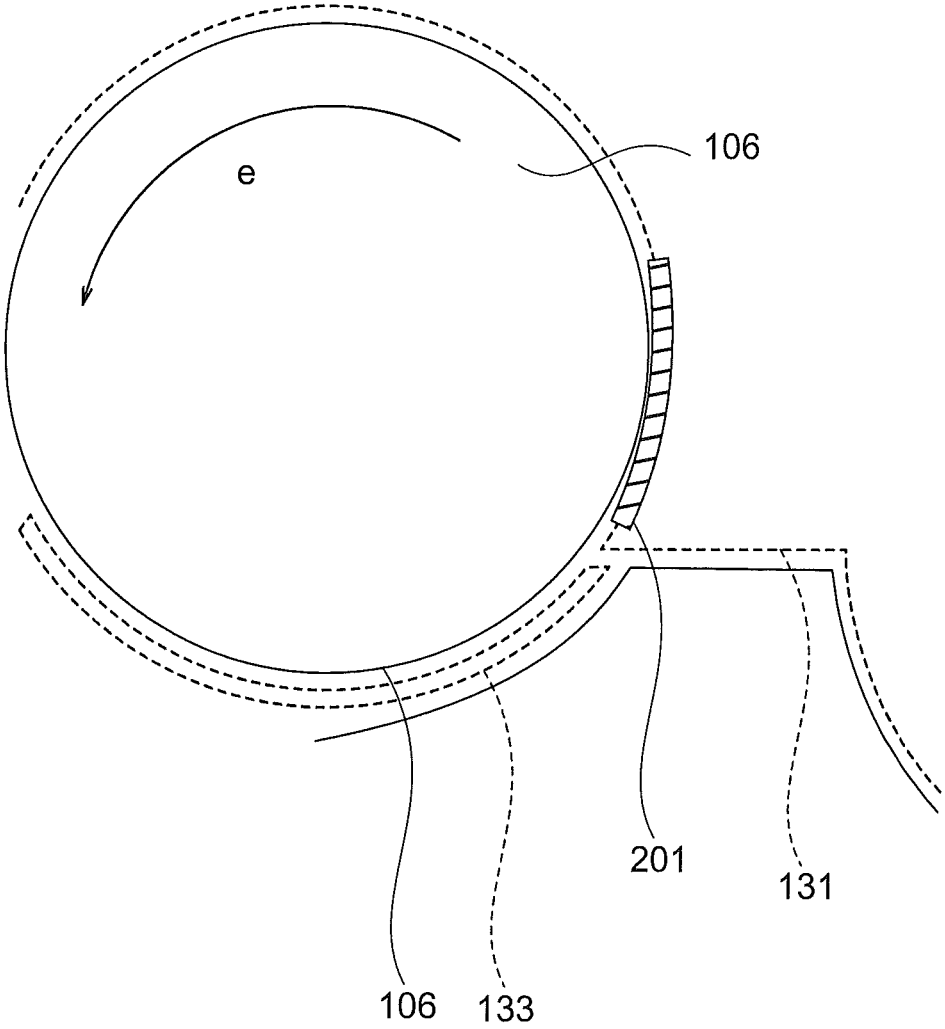
FIG. 15 is an enlarged view of a part of the image forming unit shown in FIG. 14.

FIG. 14 shows a main part of an image forming unit according to Comparison Example 2-4. In the image forming unit of Comparison Example 2-4, the charge providing member 201 is disposed on a side of the supplying roller 106. In other words, the charge providing member 201 is disposed in the toner storage portion 131 (more specifically, in the toner supplying region α). As schematically shown in FIG. 15 in an enlarged scale, the charge providing member 201 faces a part of the supplying roller 106 where a tangential line at the surface of the supplying roller 106 extends vertically. Further, the charge providing member 201 is disposed on an opposite side to the opposing portion β between the developing roller 104 and the supplying roller 106 with respect to the rotation axis of the supplying roller 106. Other components of the image forming unit are the same as those of the image forming unit 12 (FIGS. 11 and 12) of the second embodiment.

The image forming unit of Comparison Example 2-4 was mounted to the image forming apparatus, and printing tests were performed as described above. As a result, stains were found in the printed images when the voltage Vf was in a range from −400V to −800V. Further, when the voltage Vf was in a range from +100 to −300V, the image densities were low, and printed images were at an unacceptable level.

In the image forming units of Comparison Examples 2-1 and 2-4, the charge providing member 201 is disposed in the toner storage portion 131. However, in the toner storage portion 131, the toner collected from the developing roller 104 by the supplying roller 106 and the newly supplied toner are mixed with each other. Therefore, the provision of the charge providing member 201 in the toner storage portion 131 may make a mixture ratio unstable, or may bring about other undesirable results. In order to charge the toner in a stabilized manner, the charge providing member 201 is preferably disposed in the collected toner conveying portion 133 rather than the toner storage portion 131.

<Effects>

As described above, according to the second embodiment, the charge providing member 201 is provided so as to face the surface of the supplying roller 106. In the rotating direction of the supplying roller 106, the charge providing member 201 is disposed on the downstream side of the opposing portion β between the supplying roller 106 and the developing roller 104, and on the upstream side of the toner supplying region α where the toner storage portion 131 supplies the toner to the supplying roller 106. With such a configuration, an excellent image can be obtained as in the first embodiment.

Further, the voltage Vf of the same polarity as the toner is applied to the charge providing member 201, and the absolute value of the voltage Vf is greater than or equal to the absolute value of the sum of the supplying voltage Vsb applied to the supplying roller 106 and the electric potential of the toner layer. With such a configuration, decrease in image density after the continuous printing operation can be suppressed, and image blurring and stain can be prevented.

Third Embodiment

Figure 16:
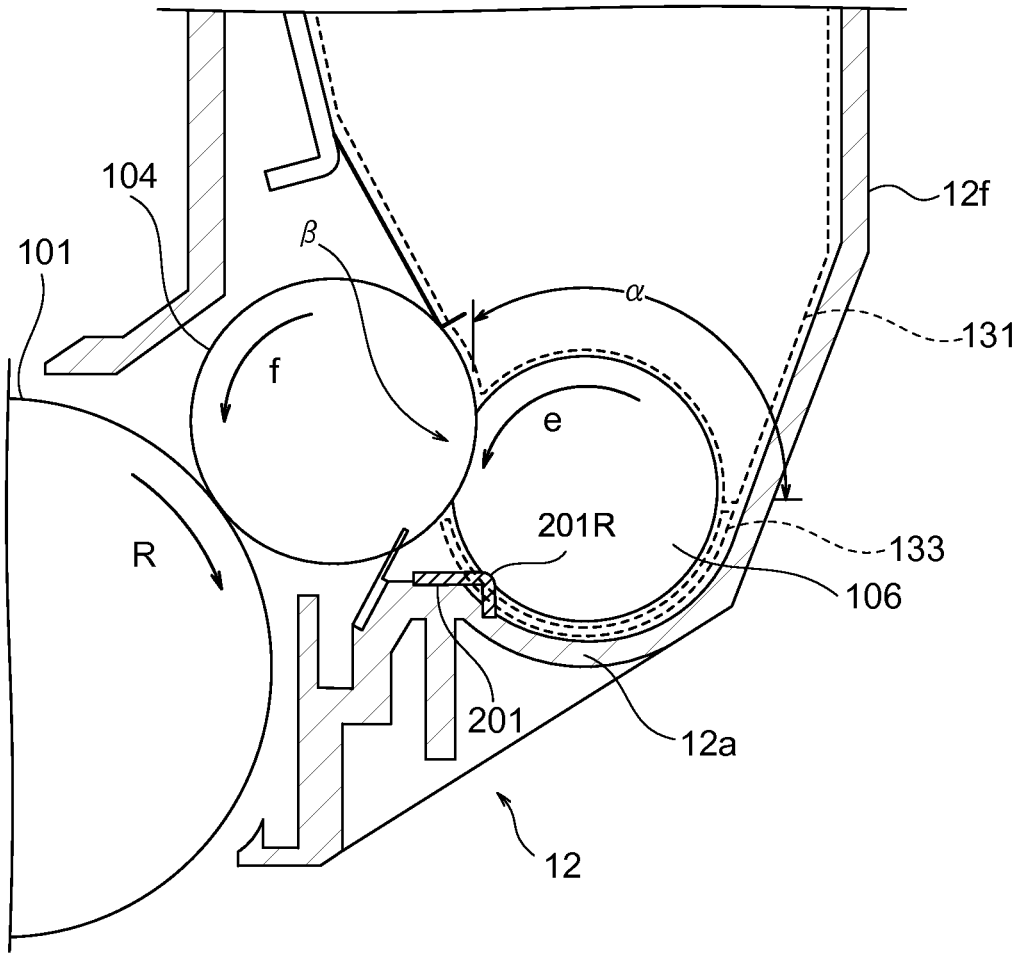
FIG. 16 is a sectional view showing a configuration of an image forming unit according to the third embodiment.

FIG. 16 is a sectional view showing a configuration of an image forming unit 12 according to the third embodiment of the present invention. In the image forming unit 12 of the third embodiment, the charge providing member 201 has a bent shape. A bent portion 201R (i.e., a curved surface portion) of the charge providing member 201 contacts the supplying roller 106.

The charge providing member 201 is disposed below the opposing portion between the supplying roller 106 and the developing roller 104. The charge providing member 201 has a bent shape having a substantially L-shape in a cross section perpendicular to the axial direction of the supplying roller 106. An outer curved surface (i.e., the bent portion 201R) of the charge providing member 201 contacts the supplying roller 106. Other components are the same as those of the image forming unit 12 of the first embodiment.

<Printing Tests>

The image forming unit 12 (FIG. 16) of the third embodiment was mounted to the image forming apparatus, and printing tests described in the first embodiment were performed while varying the voltage Vf (applied to the charge providing member 201) to −800V, −700V, −600V, −500V, −400V, −300V, 0V and +100V.

Figure 17:
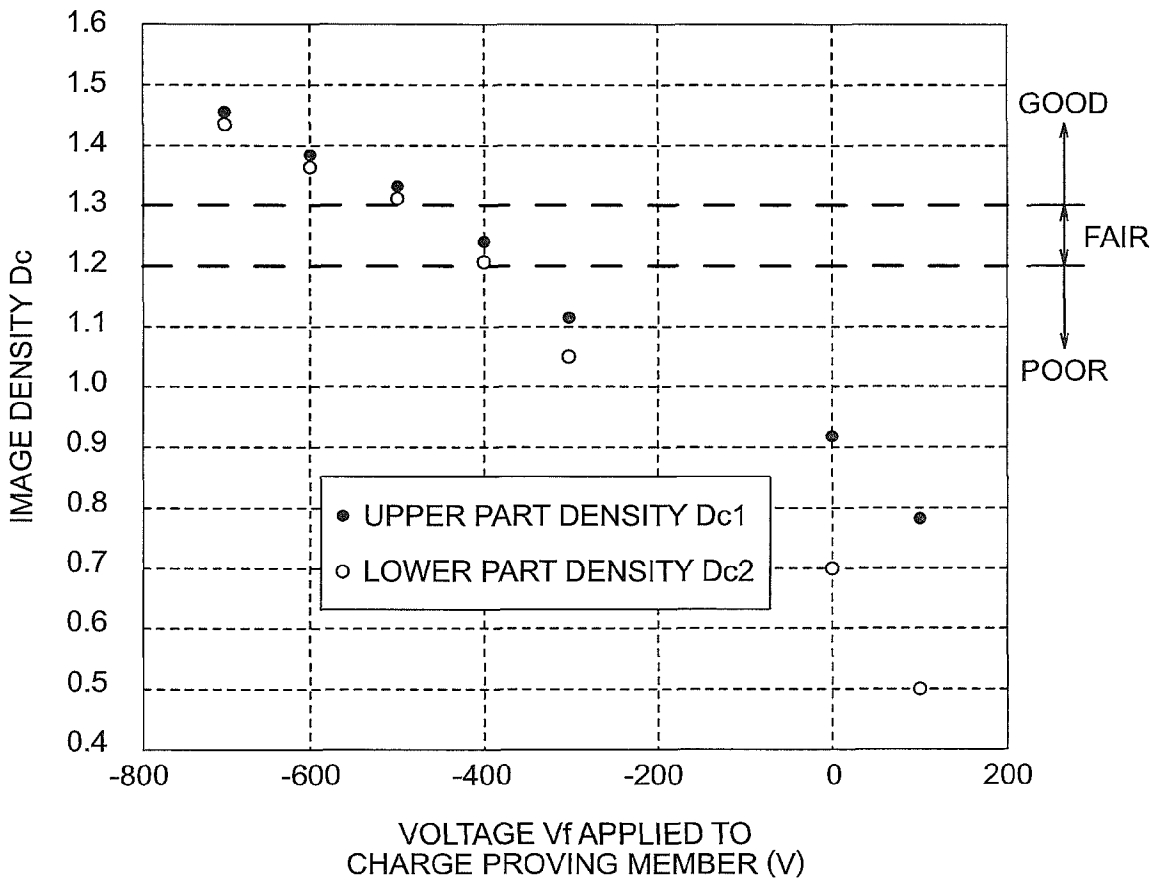
FIG. 17 is a graph showing measurement results of image densities of an upper part and a lower part of a printed image.

TABLE 3 shows measurement results of the upper part density Dc1 and the lower part density Dc2. FIG. 17 is a graph illustrating the measurement results shown in TABLE 3.

TABLE 3

| | IMAGE DENSITY Dc | | | IMAGE QUALITY EVALUATION | | |
|---|---|---|---|---|---|---|
| Vf (V) | Dc1 | Dc2 | DENSITY EVALUATION | IMAGE BLURRING | STAIN | TOTAL EVALUATION |
| +100 | 0.78 | 0.50 | poor | poor | good | poor |
| 0 | 0.91 | 0.70 | poor | poor | good | poor |
| −300 | 1.11 | 1.05 | poor | poor | good | poor |
| −400 | 1.23 | 1.20 | fair | good | good | fair |
| −500 | 1.33 | 1.31 | good | good | good | good |
| −600 | 1.38 | 1.36 | good | good | good | good |
| −700 | 1.45 | 1.43 | good | good | good | good |
| −800 | 1.52 | 1.50 | good | good | poor | poor |

In TABLE 3 and FIG. 17, when the voltage Vf was in a range from −700V to −500V, a sufficient image density was obtained. Further, neither image blurring nor stain was observed. In contrast, when the voltage Vf is −800V, stains were observed in the non-printing area (the margin area) of the printing sheet 18. Further, when the voltage Vf is in a range from −300V to +100V, image densities were low, and image blurring was observed.

In the third embodiment, the charge providing member 201 is provided so as to face the surface of the supplying roller 106. In the rotating direction of the supplying roller 106, the charge providing member 201 is disposed on the downstream side of the opposing portion β between the supplying roller 106 and the developing roller 104 and on the upstream side of the toner supplying region α where the toner storing portion 131 supplies the toner to the supplying roller 106. From the results of the printing tests, it is understood that decrease in image density after the continuous printing operation can be suppressed and image blurring and stain can be prevented when the voltage Vf of the same polarity as the toner is applied to the charge providing member 201, and when the absolute value of the voltage Vf is greater than or equal to the absolute value of the sum of the supplying voltage Vsb applied to the supplying roller 106 and the electric potential of the toner layer.

Figure 18:
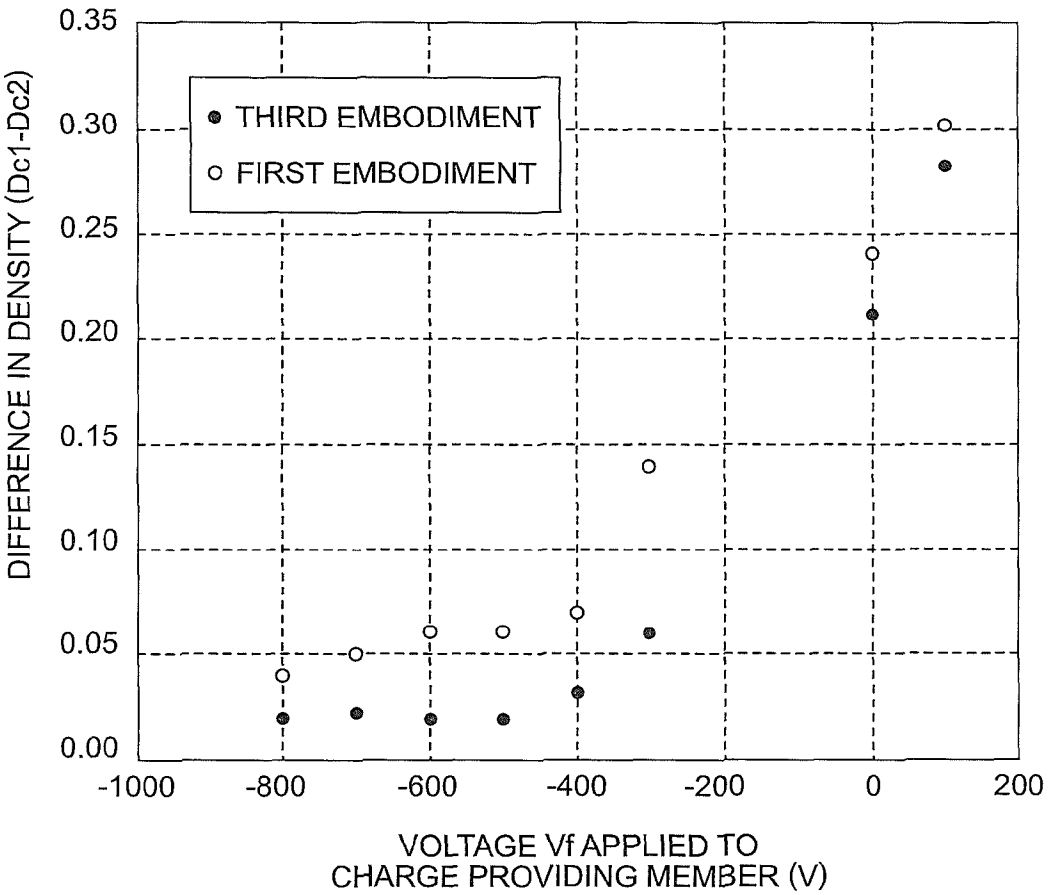
FIG. 18 is a graph showing measurement results of a difference in image densities between the upper part and the lower part of the printed image.

TABLE 4 shows a difference (Dc1−Dc2) between the upper part density Dc1 and the lower part density Dc2 determined based on values shown in TABLE 3. TABLE 4 also shows a difference (Dc1−Dc2) between the upper part density Dc1 and the lower part density Dc2 according to the first embodiment. FIG. 18 is a graph showing the results of TABLE 4.

TABLE 4

| | DIFFERENCE IN DENSITY (Dc1 − Dc2) | |
|---|---|---|
| Vf (V) | THIRD EMBODIMENT | FIRST EMBODIMENT |
| +100 | 0.28 | 0.30 |
| 0 | 0.21 | 0.24 |
| −300 | 0.08 | 0.14 |
| −400 | 0.03 | 0.07 |
| −500 | 0.02 | 0.06 |
| −600 | 0.02 | 0.06 |
| −700 | 0.02 | 0.05 |
| −800 | 0.02 | 0.04 |

During a time period after the image forming unit 12 is activated and before the image forming unit 12 starts a developing process (i.e., before the toner moves from the developing roller 104 to the exposed part of the photosensitive drum 101), the toner is charged without being used for development. This is referred to an idle charging. The upper part density Dc1 tends to be high due to the effect of the idle charging. In contrast, the lower part density Dc2 is not likely to be subject to the effect of the idle charging, and therefore tends to be lower as compared with the upper part density Dc1. Therefore, a difference in density between the upper part density Dc1 and the lower part density Dc2 is likely to be generated. The smaller the difference in density is, the better the image quality is. Particularly, it is preferable that the difference in density (Dc1−Dc2) is smaller than or equal to 0.05.

From the results shown in TABLE 4 and FIG. 18, it is understood that the upper part density Dc1 in the third embodiment is lower than in the first embodiment, and that the difference in density (Dc1−Dc2) in the third embodiment is smaller than in the first embodiment. In other words, the difference in density (Dc1−Dc2) can be reduced by a configuration in which the bent portion 201R of the charge providing member 201 contacts the supplying roller 106.

This is thought be because the bent portion 201R of the charge providing member 201 contacts the supplying roller 106 with the result that a pressing force is concentrated on the contact portion between the charge providing member 201 and the supplying roller 106. This enhances an effect in regulating an amount of the toner collected by the supplying roller 106.

As an alternative example, the charge providing member 201 can be made of a conductive member having a cylindrical shape whose axial direction is parallel to the axial direction of the supplying roller 106. An outer circumferential surface (i.e., a curved surface) of the charge providing member 201 contacts the supplying roller 106. Such a configuration provides the same effect as the configuration in which the bent portion 201R of the charge providing member 201 contacts the supplying roller 106 as shown in FIG. 16. In this regard, it is also possible to rotate the cylindrical conductive member.

<Effects>

As described above, according to the third embodiment, the curved surface such as the bent portion 201R of the charge providing member 201 contacts the supplying roller 106, and therefore the difference in image density can be reduced, in addition to the effects described in the first embodiment.

In the above described embodiment, the electrophotographic printer has been described. However, the present invention is not limited to the electrophotographic printer, but is applicable to a facsimile, a copier, an MFP (Multifunction Peripheral) and the like using electrophotographic system.

While the preferred embodiments of the present invention have been illustrated in detail, it should be apparent that modifications and improvements may be made to the invention without departing from the spirit and scope of the invention as described in the following claims.

What is claimed is:

1. An image forming unit comprising:

a developer bearing body that bears a developer;

a supplying member provided so as to face the developer bearing body, the supplying member rotating to collect the developer from the developer bearing body and supply the developer to the developer bearing body;

a developer storage portion that stores the developer to be supplied to the supplying member; and a charge providing member that charges the developer held on the supplying member;

wherein, in a rotating direction of the supplying member, the charge providing member is disposed on a downstream side of an opposing portion between the developer bearing body and the supplying member;

wherein a first voltage is applied to the supplying member;

wherein a non-voltage-application time period is provided after the first voltage is applied to the supplying member, the charge providing member being applied with no voltage during the non-voltage-application time period;

wherein a second voltage is started to be applied to the charge providing member when the non-voltage-application time period elapses; and wherein the non-voltage-application time period corresponds to a time period required for the supplying member to rotate at least one turn.

2. The image forming unit according to claim 1, wherein:

the second voltage applied to the charge providing member is a direct voltage of the same polarity as the developer; and an absolute value of the second voltage is greater than or equal to an absolute value of a sum of the first voltage applied to the supplying member and an electric potential of a layer of the developer held on the supplying member.

3. The image forming unit according to claim 2, wherein an absolute value of the second voltage applied to the charge providing member is less than or equal to 2 times an absolute value of the first voltage applied to the supplying member.

4. The image forming unit according to claim 1, wherein the charge providing member is provided so as to contact the supplying member.

5. The image forming unit according to claim 1, wherein the charge providing member is made of a plate spring.

6. The image forming unit according to claim 1, wherein the charge providing member has a curved surface portion that contacts the supplying member.

7. The image forming unit according to claim 1, wherein:

the developer storage portion is disposed above the supplying member; and in the rotating direction of the supplying member, the developer storage portion is disposed on an upstream side of the opposing portion between the developer bearing body and the supplying member.

8. The image forming unit according to claim 1, further comprising a collected developer conveying portion that forms a path for conveying the developer collected from the developer bearing body by the supplying member;

wherein, in the rotating direction of the supplying member, the collected developer conveying portion is disposed on a downstream side of the opposing portion between the developer bearing body and the supplying member; and wherein the charge providing member is disposed in the collected developer conveying portion.

9. The image forming unit according to claim 1, further comprising a developer replenishing unit for replenishing the developer to the developer storage portion;

wherein a replenishing opening is disposed on an upper part of the developer storage portion; and wherein the developer is replenished from the developer replenishing unit to the developer storage portion via the replenishing opening.

10. The image forming unit according to claim 1, further comprising a developer replenishing unit for replenishing the developer to the developer storage portion;

wherein a replenishing opening is located at a lateral position with respect to the developer storage portion; and wherein the developer is replenished from the developer replenishing unit to the developer storage portion via the replenishing opening.

11. An image forming apparatus comprising:

the image forming unit according to claim 1;

a supplying member power source that applies the first voltage to the supplying member; and a charge providing member power source that applies the second voltage to the charge providing member.

12. An image forming unit comprising:

a developer bearing body that bears a developer;

a supplying member provided so as to face the developer bearing body, the supplying member rotating to collect the developer from the developer bearing body and supply the developer to the developer bearing body; and a developer storage portion that stores the developer to be supplied to the supplying member;

wherein, in a rotating direction of the supplying member, a charge providing member is disposed on a downstream side of an opposing portion between the developer bearing body and the supplying member;

wherein a first voltage is applied to the supplying member;

wherein a non-voltage-application time period is provided after the first voltage is applied to the supplying member, the charge providing member being applied with no voltage during the non-voltage-application time period;

wherein a second voltage is started to be applied to the charge providing member when the non-voltage-application time period elapses; and wherein the non-voltage-application time period corresponds to a time period required for the supplying member to rotate at least one turn.

13. The image forming unit according to claim 12, wherein the second voltage applied to the charge providing member is a direct voltage of the same polarity as the developer;

wherein an absolute value of the second voltage is greater than or equal to an absolute value of a sum of the first voltage applied to the supplying member and an electric potential of a layer of the developer held on the supplying member.

14. The image forming unit according to claim 13, wherein an absolute value of the second voltage applied to the charge providing member is less than or equal to 2 times an absolute value of the first voltage applied to the supplying member.

15. The image forming unit according to claim 12, further comprising a collected developer conveying portion that forms a path for conveying the developer collected from the developer bearing body by the supplying member;

wherein, in the rotating direction of the supplying member, the collected developer conveying portion is disposed on a downstream side of the opposing portion between the developer bearing body and the supplying member; and wherein the charge providing member is disposed in the collected developer conveying portion.

16. An image forming apparatus comprising:

the image forming unit according to claim 12;

a supplying member power source that applies the first voltage to the supplying member; and a charge providing member power source that applies the second voltage to the charge providing member.

17. An image forming unit comprising:

a developer bearing body that bears a developer;

a supplying member provided so as to face the developer bearing body, the supplying member rotating to collect the developer from the developer bearing body and supply the developer to the developer bearing body;

a frame provided so as to cover the supplying member; and a charge providing member that charges the developer held on the supplying member;

wherein the charge providing member is disposed between the supplying member and the frame;

wherein, in a rotating direction of the supplying member, the charge providing member is disposed on a downstream side of an opposing portion between the developer bearing body and the supplying member;

wherein a first voltage is applied to the supplying member;

wherein a non-voltage-application time period is provided after the first voltage is applied to the supplying member, the charge providing member being applied with no voltage during the non-voltage-application time period;

wherein a second voltage is started to be applied to the charge providing member when the non-voltage-application time period elapses; and wherein the non-voltage-application time period corresponds to a time period required for the supplying member to rotate at least one turn.

18. The image forming unit according to claim 17, wherein the second voltage applied to the charge providing member is a direct voltage of the same polarity as the developer;

wherein an absolute value of the second voltage is greater than or equal to an absolute value of a sum of the first voltage applied to the supplying member and an electric potential of a layer of the developer held on the supplying member.

19. The image forming unit according to claim 18, wherein an absolute value of the second voltage applied to the charge providing member is less than or equal to 2 times an absolute value of the first voltage applied to the supplying member.

20. The image forming unit according to claim 17, further comprising a collected developer conveying portion that forms a path for conveying the developer collected from the developer bearing body by the supplying member;

wherein, in the rotating direction of the supplying member, the collected developer conveying portion is disposed on a downstream side of the opposing portion between the developer bearing body and the supplying member; and wherein the charge providing member is disposed in the collected developer conveying portion.

21. An image forming apparatus comprising the image forming unit according to claim 1.

22. An image forming apparatus comprising:

the image forming unit according to claim 17;

a supplying member power source that applies the first voltage to the supplying member; and a charge providing member power source that applies the second voltage to the charge providing member.

* * * * *